US010961013B2

(12) United States Patent
Slattery et al.

(10) Patent No.: US 10,961,013 B2
(45) Date of Patent: Mar. 30, 2021

(54) EXPANDABLE CONTAINER

(71) Applicant: Wilverex Pty Ltd., Melbourne (AU)

(72) Inventors: Luke Slattery, Brisbane (AU); Trevor Foster, Melbourne (AU); Craig Burton, Melbourne (AU)

(73) Assignee: Wilverex Pty Ltd., Melbourne (AU)

( * ) Notice: Subject to any disclaimer, the term of this patent is extended or adjusted under 35 U.S.C. 154(b) by 0 days.

(21) Appl. No.: 16/413,377

(22) Filed: May 15, 2019

(65) Prior Publication Data

US 2019/0352042 A1 Nov. 21, 2019

(30) Foreign Application Priority Data

May 15, 2018 (AU) ..... 2018901674

(51) Int. Cl.

| | |
|---|---|
| ***B65D 5/36*** | (2006.01) |
| ***B65D 5/50*** | (2006.01) |
| ***B65D 5/66*** | (2006.01) |
| ***B65D 5/42*** | (2006.01) |

(52) U.S. Cl.

CPC ..... *B65D 5/3614* (2013.01); *B65D 5/4266* (2013.01); *B65D 5/5002* (2013.01); *B65D 5/66* (2013.01)

(58) Field of Classification Search

CPC .. B65D 5/3614; B65D 5/4266; B65D 5/5002; B65D 5/66; B65D 2571/00925; B65D 71/72; B65D 1/225; B65D 5/3628

USPC ... 229/109, 904, 117.07, 103, 108.1, 117.01, 229/117.08; 206/562, 217, 565, 564, 146, 206/216, 763; 220/575, 737; 99/426; D7/505, 601

See application file for complete search history.

(56) References Cited

U.S. PATENT DOCUMENTS

| | | | | |
|---|---|---|---|---|
| 2,833,458 A * | 5/1958 | Toensmeier | ..... | B65D 5/5021 206/562 |
| 3,001,684 A * | 9/1961 | Wenzel | ..... | B65D 5/4802 206/563 |
| 3,149,770 A | 9/1964 | Spilson | | |

(Continued)

FOREIGN PATENT DOCUMENTS

GR 20080100517 A 3/2010

OTHER PUBLICATIONS

International Search Report dated Jul. 29, 2019 in International Patent Application No. PCT/AU2019/050460, 5 pages.

*Primary Examiner* — Christopher R Demeree

(74) *Attorney, Agent, or Firm* — Shook, Hardy & Bacon LLP

(57) ABSTRACT

A container, movable between collapsed and expanded conditions, has a plurality of walls connected between bottom and top structures. A first wall of the plurality of walls includes first and second sections that connect together at a fold line about which the sections are rotatable between first wall collapsed and expanded conditions. The first section is connected to the bottom structure and the second section is connected to the top structure. The first wall is expandable by rotation of the first section relative to the second section in a first direction of rotation about the fold line from the first wall collapsed condition and into engagement with an abutment at the first wall expanded condition which arrests further rotation of the first section relative to the second section. The first wall is maintained in the first wall expanded condition by a load applied to the first wall.

18 Claims, 11 Drawing Sheets

(56) References Cited

U.S. PATENT DOCUMENTS

| | | | | |
|---|---|---|---|---|
| 3,324,998 | A * | 6/1967 | Farquhar | B65D 5/0209 206/488 |
| 3,434,650 | A * | 3/1969 | Goings | B65D 71/72 206/563 |
| 3,722,781 | A * | 3/1973 | Page | B65D 5/38 206/563 |
| 6,401,927 | B1 | 6/2002 | Sorensen et al. | |
| 7,802,684 | B2 * | 9/2010 | Shew | B65D 1/36 206/541 |

* cited by examiner

EXPANDABLE CONTAINER

PRIORITY CROSS-REFERENCE

The present application claims priority from Australian Provisional Patent Application No. 2018901674 filed May 15, 2018, the entire contents of which is hereby incorporated into this specification by this reference.

TECHNICAL FIELD

The present invention relates to containers and in particular to containers that expand for use from a collapsed condition. Much of the discussion that follows will relate to containers that are in the form of trays that are or could be used in the take away food industry, as the present invention is expected to have primary use in that industry. However, it is to be appreciated that containers of the present invention could have uses in other industries and therefore the invention is not restricted to just use in the take away food industry.

BACKGROUND OF INVENTION

The discussion of the background to the invention that follows is intended to facilitate an understanding of the invention. However, it should be appreciated that the discussion is not an acknowledgement or admission that any aspect of the discussion was part of the common general knowledge as at the priority date of the application.

Take away food restaurants utilise a variety of different containers and container trays to securely support take away food items that consumers purchase. The container trays assist consumers to carry multiple food items, or difficult to carry food items, away from a serving counter and either to seating within the restaurant or to locations away from the restaurant. The container trays can include recesses that accommodate particular food items such as drink or dessert containers or cups, and these recesses can be shaped to engage or grip the food item or items so that they are held securely and stably within the tray against dropping or tipping. Container trays can for example include circular recesses for accommodating the lower ends of drinking cups and the edge of the recesses can be arranged to engage against the sides of the drinking cups to securely locate the drinking cups upright on or within the tray. Container trays can also be configured for accommodating food items such as pizza, hot chips, hot dogs, burgers and a range of other food items as required.

Container trays can be configured for accommodating multiple different food items. Thus, for example, container trays can include recesses for accommodating a drinking cup, and/or a hot chip bag and/or a burger. This recognises that consumers will often purchase a range of different food items from take away food restaurants when dining.

Take away food restaurants use high volumes of container trays. The trays tend to be single use only and for environmental reasons, the trays are preferably recyclable and are preferably made from recycled material. The trays are therefore often made from cardboard and often partially or fully from recycled cardboard.

High use or high volume container trays are generally supplied in bulk in in bundles, in a flat, collapsed condition in order to reduce the space taken up by the trays during transport and storage at a restaurant. When required, restaurant staff remove a container tray from the bundle and assemble the tray from the flat condition by expanding it, before placing the purchased food items into the tray. This assembly therefore takes place at or adjacent the serving counter by serving personnel and is part of the serving process for each customer. The serving personnel can assemble many containers each shift and so any difficulty in assembly decreases efficiency at the counter. Many containers that are currently in use require the serving personnel to fold panels of the container to upright positions and to insert locking tabs into slots so that the panels lock into the expanded position. This requires some precision and care to ensure the container tray is properly expanded.

Many take away food restaurants overcome the decreased serving efficiency caused by serving personnel being required to assemble trays during the serving process, by pre-assembling trays and stacking them in bulk in a position that is convenient to the serving personnel. While this increases the serving efficiency, it nevertheless requires dedicated allocation of personnel resources to assemble the bulk load of trays, and the assembled trays take up greater space in the serving area than collapsed trays. The stacked body of assembled trays can also be less aesthetically pleasing than a stack of collapsed trays.

In addition, because many current container trays are made from cardboard, the edges of the panels that the serving personnel are required to manipulate can be sharp and can cause skin cuts to those personnel. This is undesirable from a staff wellbeing perspective as well as from a hygiene perspective.

The applicant has recognised that an improved or different container tray that provides advantages over prior art containers would be desirable.

SUMMARY OF INVENTION

According to the present invention there is provided, i. a container having a container collapsed condition and a container expanded condition, ii. the container having a bottom structure and a top structure and a plurality of walls connected to the bottom structure and to the top structure, iii. the container being generally flat in the container collapsed condition, and in the container expanded condition the top structure being spaced from the bottom structure a greater distance than in the container collapsed condition, iv. a first of the plurality of walls comprising first and second sections that connect together at a fold line about which the first and second sections are rotatable between first wall collapsed and expanded conditions, the first section being connected to the bottom structure and the second section being connected to the top structure, and expansion of the first wall from the first wall collapsed condition to the first wall expanded condition causes the top structure to shift away from the bottom structure, v. the first wall being expandable by rotation of the first section relative to the second section in a first direction of rotation about the fold line from the first wall collapsed condition and into engagement with an abutment at the first wall expanded condition, whereby engagement of the first wall with the abutment arrests further rotation of the first section relative to the second section about the fold line in the first direction of rotation, the first wall being maintained in the first wall expanded condition by a load applied to the first wall by the top and bottom structures that resists rotation of the first section relative to the second section in a second direction of rotation opposite to the first direction of rotation.

The top and bottom structures referred to above can take various forms. In a common form of the invention in which the container is intended for transporting drinking cups, the container will be made from folded cardboard and the top and bottom structures will be cardboard panels, in which the bottom structure is solid and the top structure has openings to accept and locate drink containers. However, containers according to the invention could have much wider use, so that the form of the top and bottom structures could be quite different.

Advantageously, a container of the above description can be expanded from the collapsed condition simply by pushing the first wall from the first wall collapsed condition in the first direction of rotation (which will often be in an inwards direction relative to other components or parts of the container), so that the first and second sections of the first wall rotate about the fold line and bring the first wall into engagement with the abutment. This brings the container to the expanded condition. There are no panels with tabs that are required to be folded into place with the tabs secured within slots as in some of the prior art. Also, there are no panels that require complex manipulation. The serving personnel need only grasp the container in the collapsed condition, such as from a stack of collapsed containers, and push on or against the first wall to cause it to fold and expand in the manner described above until the first wall has engaged the abutment and is retained in that position by the load applied by the top and bottom structures. At that point, the container is expanded and ready for use.

It is to be understood that by bringing the first wall into engagement with the abutment, the amount of the first wall that actually comes into engagement with the abutment is not particularly important as long as there is engagement and as long as the extent of engagement is sufficient to arrest further rotation of the first and sections about the fold line in the first direction of rotation and for the first wall to be maintained in the first wall expanded condition by the load applied to the first wall by the top and bottom structures. Various forms of abutments can be employed.

A container according to the invention requires the first wall to be maintained in the first wall expanded condition by a load applied to the first wall by the top and bottom structures that resists rotation of the first section relative to the second section in the second direction of rotation opposite to the first direction of rotation. By maintaining the first wall expanded condition, the container is likewise maintained in the expanded condition. While a load can be applied to the first wall to return the first wall to the collapsed condition, in absence of such a load, the first wall will be maintained in the first wall expanded condition.

The movement of the first wall between the collapsed condition and the expanded condition can include passage or travel of the first wall through a transition state, which is an unstable state. In some forms of the invention, the transition state occurs when the first and second sections of the first wall are aligned in the same plane, such as vertically aligned, or alternatively, when they are perpendicular to the top and bottom structures. Because of the instability in or at the transition state, the first wall is resistant to remaining in the transition state and so will naturally shift to either side of the transition state depending on the load applied to the first wall. If the load is sufficient to push through the transition state then once through, the first and second sections of the first wall will continue to rotate in the first direction about the fold line so that the first wall moves into the position of engagement with the abutment. It would be normal for finger pressure that is applied to the first wall to expand the first wall to continue to be applied until the first wall engages the abutment. However, the load applied to the first wall by the top and bottom structures can itself be such as to drive the first wall into the position of engagement with the abutment once the first wall has been pushed through the transition.

The first and second sections of the first wall can retain their shape through the transition state, or they can resiliently flex, distort or deform as the first wall passes through the transition state and once through, the first and second sections can resiliently recover, which can also assist or even actually drive the first wall to the position of engagement with the abutment. In either case, transition of the first wall through the transition state can be a sudden or snapping movement due to the first wall springing towards and into engagement with the abutment.

In some forms of the invention, the transition state is an over center position. Passage through an over center position can allow the first wall to toggle into engagement with the abutment, so that engagement occurs naturally and automatically once the first wall has been pushed to and through the over center position. The word "toggle" here is intended to mean that the first wall will shift to one side of the over center position or the other but will not remain in the over center position. Usually, because finger pressure is being applied to the first wall to expand it, that pressure will continue to be applied to push the first wall through the transition state, but the toggling motion will mean that there is no resistance to the movement of the first wall into engagement with the abutment.

Alternatively, the transition state might involve the first wall being bent or deformed or flexed resiliently to the transition state or position at which point or slightly after which the first wall resiliently recovers and that recovery causes the first wall to move into engagement with the abutment.

Movement through the transition state can be quick or sudden so that a container according to the invention can be expanded quickly and effortlessly.

Regardless of the form of the transition state, it can form a point or region from which the first wall can move or shift without requiring the person assembling the container to push the first wall into engagement with the abutment. Alternatively, it can form a point or region at which there is no resistance to the first wall moving or shifting into engagement with the abutment. Rather, the transition state forms a point or region at which or after which the first wall moves automatically into engagement with the abutment. This can occur by the first wall collapsing from a position in which the first and second sections of the first wall were aligned straight or aligned in the same plane, or by a recovery load resulting from the first wall recovering from being bent, flexed or deformed. The load applied by the top and bottom structures to the first wall can be a load that arises because the top and bottom structures resist being pushed apart as the first wall passes through the transition state. That is, the height of the first wall will increase as the first wall expands from the collapsed condition and the transition state can be reached close to but prior to the point at which the first wall would reach its maximum height, so that either the top and bottom structures must move apart so that the first wall can expand to its maximum height, or the first wall must bend, flex or deform, so that the first wall can continue through the transition state and onto the expanded condition in engagement with the abutment.

A container according to the invention was first developed in relation to containers for take away drink cups. The cup container was rectangular and included a base or base panel (bottom structure) and a top or top panel (top structure) and two drink cup openings formed in the top. The base presented an uninterrupted surface on which the bottom ends of the drink cups would rest. The cup container further included a pair of collapsible side walls and a pair of collapsible end walls. Each wall had a central fold line about which the respective wall could collapse and expand, although it is not essential that the fold lines be central. Each of the end walls was formed in accordance with the first wall as described above and so each of the end walls included first and second sections and each of the end walls was expandable from the collapsed condition by rotation of the first section relative to the second section about the fold line of the end wall. For further discussion of this form of the invention, reference will be made to "end walls" and these walls should be understood as having the form of the first wall discussed above.

Expansion of the end walls was made through a transition state that in a first form of the invention was an over center position and in a second form of the invention was a section of resilient flexing or deformation of the end walls. The transition state could also have a component of both in which there was passage past an over center position as well as some flexing or deformation of the end walls. Once through the transition state the end walls would spring into engagement with the abutment either through the top and bottom structures applying a load to the end walls, or by the recovery of the end walls, or a combination of both. Typically, there would also be the continued application of finger pressure, applied to expand the container, that would cause the end walls to continue through the transition state and into engagement with the abutment. The mechanism was such that the end walls in the transition state would tend to push the top and bottom structures apart, however, the top and bottom structures would resist that pushing movement. Where the end walls did not bend, flex or distort, the top and bottom structures would shift slightly apart to allow the end walls to move through the over center position. But as soon as the end walls were through the over center position, the top and bottom structures would return to or towards their original spacing prior to the slight shifting apart and would drive the end walls into engagement with the abutments, or at least would not resist movement of the end walls into engagement with the abutments. In contrast, where the end walls did bend, flex or distort, their recovery once through the transition state would drive them into engagement with the abutments. Either mechanism has worked for easy and simple expansion of the container.

In the above form of the invention, the end walls each engage an abutment formed by the end edges of the side walls of the container. That engagement arrests further rotation of the first and second sections of the end walls and the end walls are maintained in this operational expanded condition by the load applied to the end walls by the top and bottom structures which bias the end walls to remain in engagement with the end edges of the side walls. The reference to operational expanded condition is a reference to the container expanded condition in which the container is ready for operation or use. It is distinguished from earlier points in the expansion of the container from the collapse condition.

In the above form of container, the serving personnel only needed to push the collapsed end walls inwardly and the container would expand. The end walls would push inwardly, through the transition state, until they engaged the end edges of the side walls, at which point the container was properly expanded and additionally, at which point the serving personnel would have a clear tactile indication that the container was ready for use.

It was immediately apparent that the manner in which the cup container described above could be expanded or erected could provide benefits over the drink cup trays that are currently in use. The cup container of the invention did not include panels that were required to be folded and located by serving personnel, but rather, folding of the panels occurred through the simple act of pushing the end panels inwardly. The panels could be pushed inwardly and without difficulty, by the application of finger pressure at the fold line of each panel. In addition, the container of the invention did not expose the serving personnel to sharp cardboard edges that could injure the personnel. The container of the invention could however continue to be manufactured from cardboard and could still be transported and stored flat or collapsed. So the advantages of existing cup containers were maintained along with further advantages as outlined.

The container according to the invention that was first developed for take away drink cups as discussed above was developed for accepting a pair of cups. However, what was also immediately apparent upon its development was that the characteristics of the cup container could be replicated in cup containers having different drink cup capacities (four cups for example) as well as containers for other food items or for multiple food items, or for items that are not food items. Thus, it became apparent that the container according to the invention can also be configured for accommodating food items such as pizza, hot chips, hot dogs, burgers, cakes and a range of other items as required.

In the container according to the invention that was first developed in relation to containers for take away drink cups, the end walls were maintained in the expanded condition by a load or bias applied to the end walls by the top and bottom structures which biased the end walls to remain in engagement with the end edges (abutments) of the side walls. That bias was achieved by creating a resistance to displacement of the top structure away from the bottom structure as the container was expanded. In that form of the invention, the resistance was created as the top structure approached or reached the expanded condition of the container relative to the bottom structure so that the resistance did not apply throughout the entire expansion of the container, or at least the resistance was minor or negligible. Thus, as the container approached or reached the expanded condition, resistance to expansion commenced or intensified so that as the end walls rotated through the transition state, the resistance biased the end walls to collapse or recover from flexing or deforming, in the direction to engage the end edges of the side walls. Once engaged, further collapse of the end walls was arrested and the container maintained the expanded condition with the end walls continuing to be biased into engagement with the end edges of the side walls by the load applied by the bottom and top structures.

The load or bias created by the top and bottom structures could be created in any suitable manner. In some forms of the invention, the spacing between the bottom structure and the top structure is set by the height of the side walls in the expanded condition of the container. In this form of the invention, upon the maximum expansion of the side walls being reached, further separation of the top structure from the bottom structure is prevented or is not available. In this form of the invention, the transition state (such as the over center position of the end walls) is reached after the maximum expansion of the side walls is reached, and thus after the maximum spacing between the top and bottom structures is reached. Thus, to pass through the transition state, there must be some flexibility or elasticity in either the end walls, or the top and bottom structures, or the side walls, to allow further passage of the end walls (such as to the over center position), but once through the transition state, the flexibility or elasticity must be such as to apply a load or bias to the end walls to cause them to collapse into engagement with the respective abutments (being the end edges of the side walls). In some forms of the invention, the end walls are resiliently flexible so that the end walls flex to pass through the transition state and then recover, which causes the end walls to engage the end edges of the side walls.

In some forms of the invention, one or both of the top and bottom structures have connecting sections that connect to the end walls and that can flex or pivot or bend relative to a main body of the top and bottom structures. These connecting sections flex or pivot or bend relative to the main body of the top and bottom structures when the top and bottom structures have reached their positions at the container expanded condition, but prior to the end walls reaching the transition state. Flexing or pivoting or bending of the connecting sections allows further expansion of the end walls through the transition state, i.e. to the over center position and once through that position, the end walls are subject to the load or bias applied by the top and bottom structures through the connecting sections to bring the end walls into engagement with the end edges of the side walls.

In other forms of the invention, the side walls resist separation of the top and bottom structures but allow sufficient separation that the end walls can reach the position of the transition state and rotate or flex past that position and into engagement with the end edges of the side walls. In this arrangement, the side walls can expand from a collapsed condition to an expanded condition by folding about the fold line from an initial acute angle in the collapsed condition to an obtuse angle in the expanded condition, but without reaching a straight angle, i.e. an angle of 180°. Thus, in the container expanded condition, the side walls have a slight bend about the fold line. In the container expanded condition, the side walls would be arranged to exert a bias on the top and bottom structures tending to pull them towards each other so that the top and bottom structures will exert a bias on the end walls tending to cause them to shift into engagement with the end edges of the side walls once they are past the transition state and to remain in that engagement. The side walls can be arranged to have a natural resistance to expansion towards their maximum expanded position which enables them to exert the bias on the top and bottom structures. That is, the side walls can expand about the fold line towards but not to reach the maximum expanded position, such as the 180° or straight angle position.

By the above arrangement, when the end walls engage the end edges of the side walls, the top and bottom structures are fixed in their spacing relative to each other and the angle defined by the side walls is fixed. The side walls continue to apply a load or bias to the end walls through the top and bottom structures and so the container retains the expanded condition.

It needs to be appreciated that forms of cardboard containers according to the invention envisaged to date, are intended to have a very short usage life, for example a life that can involve nothing more than travel between a food outlet counter and a table of the food outlet, before the container is discarded. Therefore, it has been found to be acceptable for the mechanism of passage of the end wall or walls through the transition state to include actual damage to the container, in the form of ripping or tearing. Thus, the connecting sections discussed above can be sections that only occur at corners of the container where the end wall or walls connect to the top and bottom structures and the top and bottom structures connect to the side walls. The connecting sections can be sections that tear or rip to facilitate movement of the end wall or walls through the transition state, by allowing the end wall or walls to straighten through the transition state. Between the corners of the container, where the top and bottom structures are not connected to the side walls, the top and bottom structures might bow or bend. The tearing or ripping can allow the end wall or walls to move through the transition state after which the top and bottom structures can urge or at least not resist the end wall or walls continuing onto engagement with the abutment. The tearing or ripping is only very minor as to have a negligible affect on the structural integrity of the container in the expanded condition.

The container discussed above has been described in relation to a first development of the invention that was made in relation to a drink cup container for accommodating two drink cups. That container was rectangular and thus had a pair of parallel long walls and a pair of parallel short walls. The end walls discussed above were the short walls in that form of the invention. However, it should be appreciated that the end walls could alternatively be the long walls of the container.

Since developing the form of the invention discussed above, it is apparent that the invention has much wider application. For example, the invention can be embodied in a drink cup container or drink cup tray which has capacity for more than two drink cups. This could be a container or tray that can accommodate four drink cups for example. The container or tray could be square or rectangular. A single end wall that operates in the manner discussed above could be provided, or more preferably, opposite end walls that act in that manner could be provided.

It will also be apparent that the invention has application to containers or trays that accommodate items other than or in addition to drink cups. Other food items can be accommodated as can non-food items such as seedling trays for nurseries, a body of soil for seedlings, pencils, toys, etc.

The application of the invention to drink cup containers or trays is just one food item for which the invention could be applied. In the fast food industry, the invention could provide a container with openings for drink cups and dessert cups for example, and a tray section for burgers, hot dogs and chip containers and other items not served in cups.

In the food industry generally, the invention can be applied to packaging for pizza, cakes, sandwiches etc. For those types of food items, the top structure can be uninterrupted or in other words, it can be completely closed. The top structure can thus be a solid panel. The top structure could include a hinged lid and food items could be placed in the container and the lid would close over the items. Alternatively, one of the side walls could be formed as a flap that can be opened so that a pizza or the like could be slid into the container through the side wall and then the side wall can be closed. In alternative arrangements, the top structure can include an opening in the forms of a window that allows the food item therein to be observed. The window can be closed or covered by transparent plastic or cellophane, or the window can be open.

The top structure can include a hinged lid or cover portion that can be opened for access to the inside of the container.

The invention has been described above in relation to square or rectangular containers where one wall, or a pair of walls, has a fold line about which the first and second sections of that wall can rotate to expand the wall from a collapsed condition through a transition state, such as an over center position. It is within the scope of the invention however to provide containers that have a different shape. For example, the invention could embody containers having a hexagonal or octagonal periphery. In these containers, preferably two opposite walls, or walls that face each other are walls that can expand from a collapsed condition through a transition state and into engagement with an abutment.

It is also within the scope of the present invention for containers to have more than two walls that can expand from a collapsed condition through a transition state and into engagement with an abutment. For example, a hexagonal container could have three walls formed in that manner. The invention also embodies containers that have a single wall (hereinbefore termed a "first wall") that can expand from a collapsed condition through an over center position and into engagement with an abutment and these containers can for example, form open containers, such as fast food chip containers. In these containers, the first wall can form a base on which the container can be placed and opposite the base the container can be open to receive a serve of chips. In this orientation, the top and bottom structures will be upright in use.

The discussion above has referred to engagement of the first wall with the abutment to arrest rotation of the first section of the first wall about the fold line relative to the second section. Upon that engagement, the container is in the expanded or operational expanded condition. The container is maintained in the expanded condition by a bias or load applied to the first wall by the top and bottom structures that resists rotation of the first wall in the opposite direction of rotation. While this bias or load will be sufficient for many applications of the invention, for further security to retain the container in the expanded condition, the first wall can be locked or secured in place in the expanded condition of the container. Likewise, each wall that operates as the first wall operates (the pair of end walls for example that have been described above) can be locked or secured in place in the expanded condition of the container. Thus, the container discussed above that has two end walls that expand through a transition state can have each of those walls locked or secured in place.

In some forms of the invention, the first wall is locked or secured in place by a locking tab extending through the wall. The locking tab can pass through an opening in the first wall to secure the first wall against lateral movement relative to the abutment (the end edges of the side walls for example). The locking tab can alternatively also engage on the opposite side of the first wall when the first wall has engaged the abutment. The abutment can include the locking tab or it can extend from a different part of the container, such as the top or bottom structure. Conveniently, the locking tab can extend from the end edges of one or both of the side walls of a container according to the invention and the position of the locking tab or tabs can be such that the locking tab or tabs align with openings in the end walls as the end walls reach a position that is close to the expanded position, such as just prior to, or just after, or at the transition state. In this manner, the locking tabs will be received within and extend through the openings as the end walls move to the expanded position and the receipt will be complete when the end walls engage the abutments.

The locking tabs can include a leading end that engages the opposite side of the end wall and that provides the locking or securing function. The leading end can be formed as an enlarged head or barb for example. In order to extend through the opening and to thereafter engage the opposite side of the end wall, the leading end can be turned or twisted after extension through the opening, or more preferably, the leading end can flex or resiliently distort as it extends through the opening and recover on complete passage through the opening. In either case, the leading end will then be in contact with the opposite side of the end wall, or alternatively will engage the opposite side of the end wall upon a load being applied to the end wall that tends to separate the end wall from engagement with the abutment.

In other forms of the invention, the first wall is locked or secured in place in the container expanded condition, by a locking tab or tabs that extend from the first wall and which are captured in openings in the side wall or walls, such as in the leading edges of the side wall or walls. An opening or openings provided in the leading edge or edges of the side wall or walls can have an open entry so that the locking tab or tabs can enter the opening or openings as the first wall reaches a position that is close to the expanded position. Full entry of the locking tab or tabs occurs when the first wall engages the abutment. The locking tab or tabs can interact with the opening or openings so that reverse movement of the first wall away from the abutment is resisted or prevented. The opening or openings can engage on the opposite side of the first wall to the abutment when the first wall has engaged the abutment. To facilitate this, the entry of the opening or openings can be smaller than the portion of the locking tab or tabs that enters the opening or openings so that the locking tab or tabs have to physically push into the opening or openings past the entry and so that following entry, edges of the entry overlie a facing the surface of locking tab or tabs.

The container according to the invention can be formed of any suitable material, but the preference at this stage is to use cardboard, being either solid or fluted cardboard. Advantageously, the present invention can be formed from recycled cardboard and when formed from that material, the container itself can be recycled. Alternatively, the container can be formed from plastic or other suitable materials.

Where the container is formed from cardboard, the container can be formed in two parts which can be connected together, such as by adhesive. In some forms of the invention, the top structure is one part and the bottom structure and walls is the other part. In other forms of the invention, the top structure and walls is one part and the bottom structure is the other part. For adhesive connection between the two parts, the end of the walls that connect to the top or bottom part can include a glue flap for that adhesive connection.

BRIEF DESCRIPTION OF DRAWINGS

In order that the invention may be more fully understood, some embodiments will now be described with reference to the figures in which.

DETAILED DESCRIPTION

Figure 1:
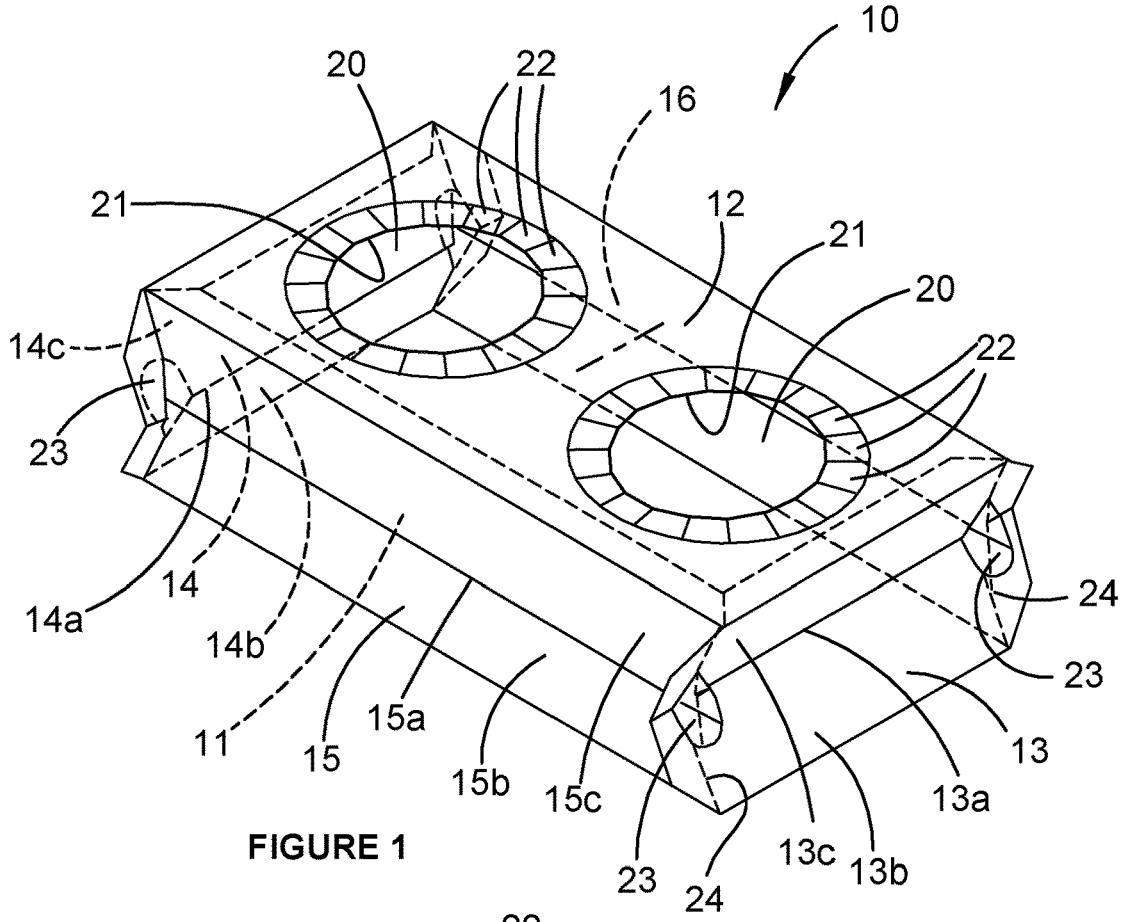
FIG. 1 is a perspective view of a container according to one embodiment of the invention.

FIG. 1 is a perspective view of a container 10 according to one embodiment of the invention. The container 10 is shown transparent to enable all parts of the container to be described. The container 10 has been developed as a drink cup container for accommodating a pair of drink cups. Obviously the container 10 could be used for other cup products, such as desserts, or it can be used for multiple food products such as a drink cup and a dessert cup.

The container 10 is shown in an expanded or operational condition and this will be contrasted with a collapsed condition which will be described later herein in relation to FIGS. 3 and 5*a*. In respect of FIG. 1, the container has a bottom structure 11, a top structure 12 and four walls that connect between the top and bottom structures 11 and 12.

The four walls comprise end walls 13 and 14 and side walls 15 and 16. Given that the container 10 is formed to have a rectangular shape or periphery, the end walls 13 and 14 are the short walls, while the side walls 15 and 16 are the long walls. In the expanded condition shown in FIG. 1, the top structure 12 is spaced from the bottom structure 11 and the respective structures 11 and 12 are generally parallel. The bottom structure 11 forms an uninterrupted flat base, while the top structure 12 includes a pair of drink cup openings 20. Each of the openings 20 has a perforated or slotted periphery to form a series of adjacent teeth 22. The leading ends 21 of the teeth 22 engage against the side wall of a drink cup inserted into the opening 20 and the teeth can be pushed downwardly to accommodate the diameter of the drink cup as the cup is pushed into the opening 20. This toothed arrangement is already known in drink cup containers.

Each of the walls 13 to 16 includes a generally central fold line 13*a* to 16*a*. Each of the walls 13 to 16 includes first and second sections on either side of the respective fold lines 13*a* to 16*a* and which are rotatable relative to each other about a respective fold line, between collapsed and expanded conditions. FIG. 1 shows each of the walls 13 to 16 in the expanded condition of the container 10.

The walls 13 to 16 thus include first sections 13*b* to 16*b* and second sections 13*c* to 16*c*. The first sections are connected to the bottom structure 11 and the second sections are connected to the top structure 12. It will be appreciated that while the fold lines 13*a* to 16*a* are shown centrally of the first and second sections, they could be other than central.

The walls 13 to 16 each define a concave shape when viewed from the exterior of the container 10. The concavity of the end walls 13 and 14 is greater than that of the walls 15 and 16. The angles described by the respective walls do not need to be the same. Importantly, the walls 15 and 16 apply a load to the top and bottom structures 12 and 11 biasing them towards each other and that load transfers to the end walls 13 and 14 tending to maintain the end walls in the position shown in FIG. 1. The walls 15 and 16 apply a load to the top and bottom structures 12 and 11 simply through a resistance to further straightening.

In addition to the load applied to the end walls 13 and 14 by the top and bottom structures 12 and 11, locking tabs 23 extend from end edges 24 of the side walls 15 and 16. The locking tabs 23 insert into slots formed in the end walls 13 and 14 for locking the end walls 13 and 14 in place relative to the side walls 15 and 16 in the expanded condition of the container 10.

The container 10 as shown in FIG. 1 provides the openings 20 for the insertion of a drink cup (not shown). The drink cups can be inserted through the openings 20 to the point at which the bottom end of the cups rest on or engage with the upper surface of the bottom structure 11. The teeth 22 engage the drink cups about their outer surface and by this overall arrangement, the container 10 can provide a stable tray for carrying a pair of drink cups. The container 10 is very easily erected and has benefits over current drink cup trays presently known to the applicant. The manner in which the container 10 is assembled will now be described.

Figure 2:
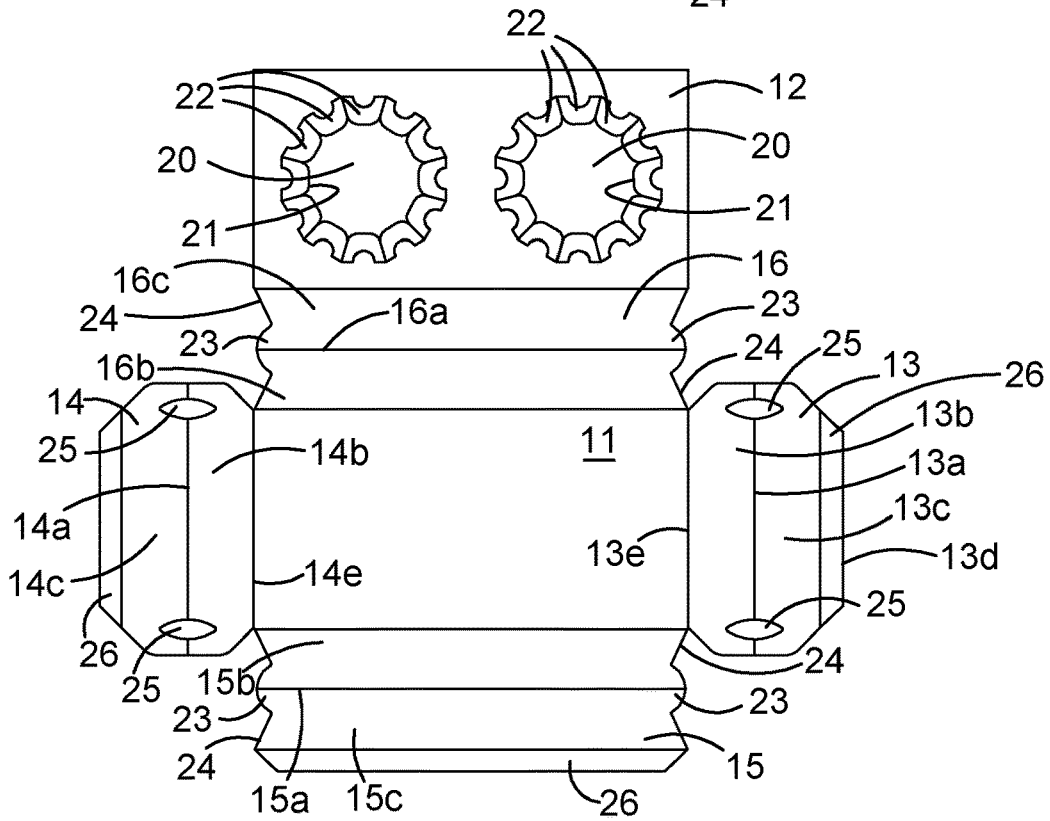
FIG. 2 is a plan view of a blank from which the container of FIG. 1 formed.

FIG. 2 illustrates a single piece blank for forming the container 10. Each of the features discussed in relation to the container 10 shown in FIG. 1 is shown in FIG. 2. In addition, the slots 25 into which the locking tabs 23 extend in the expanded condition of the container 10 are also shown.

The single piece blank shown in FIG. 2 has been die cut from cardboard, either solid or corrugated. The single piece blank has various fold lines about which the various sections of the blank can be folded for forming into the collapsed container of FIG. 3. The fold lines also assist to expand the collapsed container of FIG. 3 into the expanded container of FIG. 1. The single piece blank arrangement shown in FIG. 2 is just one way of forming the container 10 and many different arrangements could alternatively be employed.

In order to form the container 10 from the blank of FIG. 2, the walls 13 to 15 are formed with a top flap 26 that extends from the second section 13*c* to 15*c* and that can be folded for connection with an underneath facing surface of the top structure 12. The flaps 26 can be glued to the underneath surface of the top structure 12, or otherwise connected. The connection between the flaps 26 and the underneath surface of the top structure 12 forms an overlapping section 27 (shown in broken line) about the edge of the top structure 12.

Figure 3:
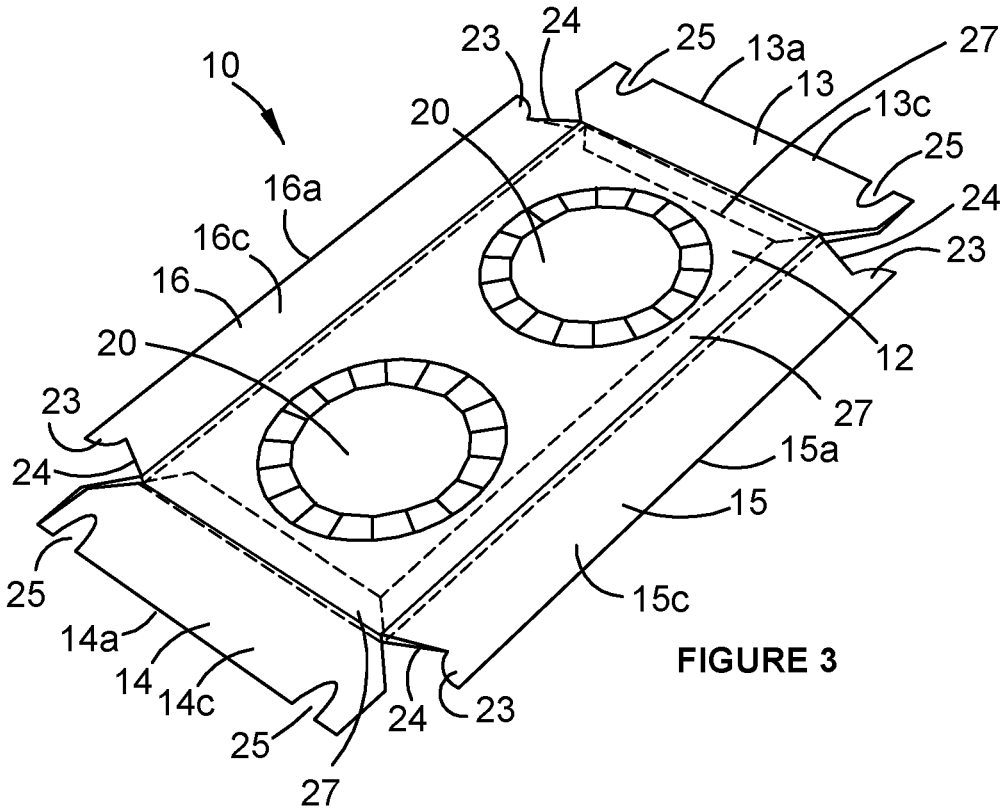
FIG. 3 is a perspective view of the container of FIG. 1 in a collapsed condition.

With reference to FIG. 3, the container 10 is shown in a collapsed condition with the top structure 12 glued into connection with the flaps 26 of the walls 13 to 15. In this collapsed condition, the top and bottom structures 11 and 12 are generally parallel, either in touching engagement, or very close together. The walls 13 to 16 are all folded about their respective fold lines 13*a* to 16*a* and the first and second sections of the walls 13 to 16 are either in touching engagement, or are at a very acute angle relative to each other. While the container 10 of FIG. 3 is shown in isolation, typically many containers 10 would be bundled together tightly in a stacked condition for storage and transport and in that bundled state, the collapsed container 10 would essentially be completely flat.

A bundle of containers 10 can be provided to a food outlet in a stacked form and successive containers 10 can be removed from the bundle as required. As each container 10 is removed for use, the springy or resilient nature of the cardboard from which the container 10 is formed will cause a slight expansion of the container 10. This is evident from FIG. 5*b* which is one of a series of figures showing the expansion of the container 10 from the collapsed condition (FIG. 5*a*) to the expanded condition (FIG. 5*e*).

Figure 4:
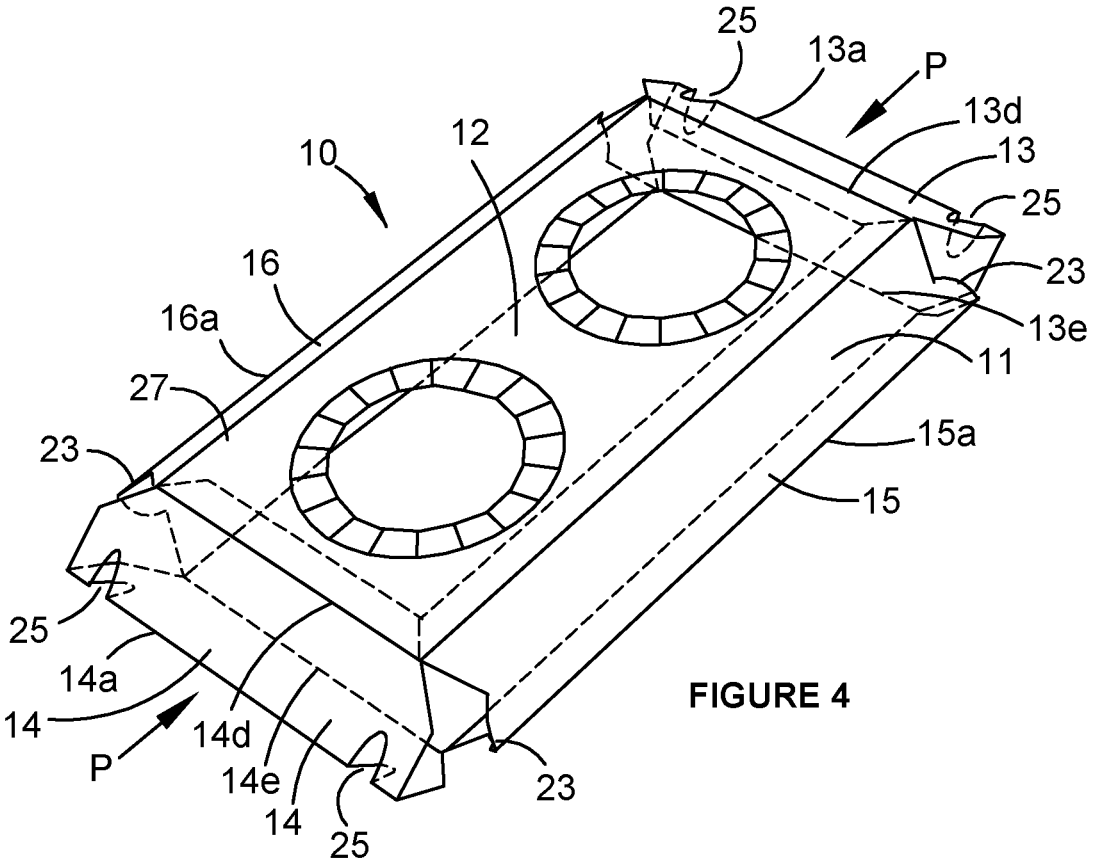
FIG. 4 is a perspective view of the container of FIG. 1 slightly expanded from FIG. 3.
Figures 5A, 5B, 5C, 5D, 5E:
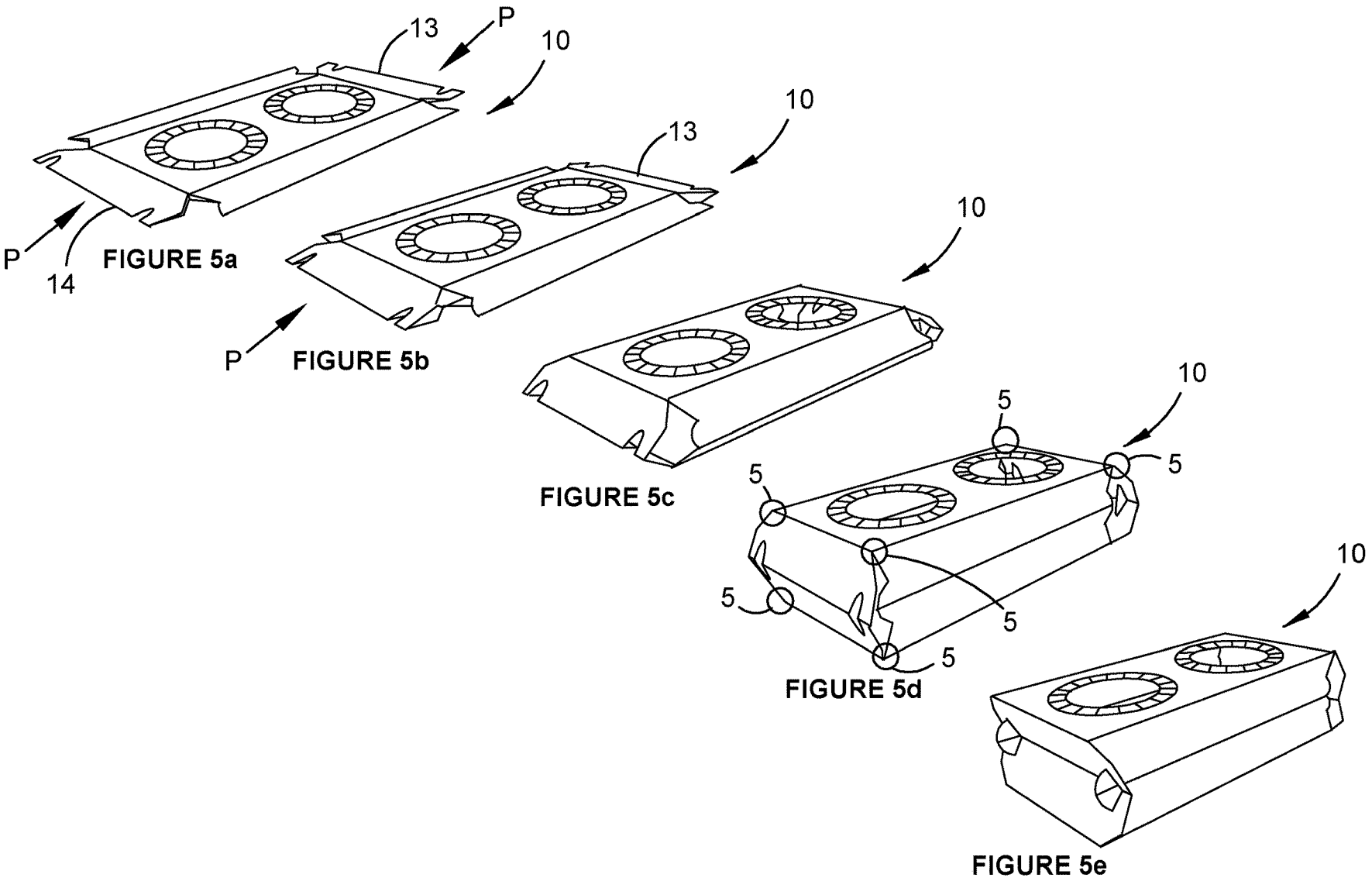
FIGS. 5*a* to 5*e* show the sequence of expansion of the container of FIG. 1.

With reference to FIG. 4 and FIGS. 5*a* to 5*e*, the container 10 can be expanded from the collapsed condition of FIG. 5*a* by a push force P (see FIG. 4) applied to the end walls 13 and 14, conveniently at the fold lines 13*a* and 14*a*. This promotes expansion of the end walls 13 and 14 from the collapsed condition through to the expanded condition of FIG. 5*e*. This expansion takes place through the transition state between FIGS. 5*d* and 5*e* to bring the container 10 into the expanded and operational condition. The push force P is simply finger pressure, and by pushing the fold lines 13*a* and 14*a* of end walls 13 and 14 inwardly in the direction of the force P, the entire container 10 will begin to expand from FIG. 5*a*. That is, the end walls 13 and 14 will begin to expand and as a result, each of the side walls 15 and 16 will also commence expansion and the top structure 12 will shift away from the bottom structure 11. This sequence of expansion is illustrated in FIGS. 5*a* to 5*e* in which FIG. 5*a* is equivalent to FIG. 3 and FIG. 5*c* is equivalent to FIG. 4.

FIG. 5*b* shows the container 10 slightly expanded such as might occur naturally as a container 10 is removed from a bundle of containers 10, as a result of the natural resilient properties of the cardboard of the container 10. Moving through FIG. 5*c* to FIG. 5*d*, the expansion of the container 10 is almost complete by continued application of pressure to the fold lines 13*a* and 14*a*, but with a final portion of expansion movement of the end walls 13 and 14 still to be achieved for the container 10 to reach or assume the operational expanded condition shown in FIG. 5*e*.

The manner in which the container 10 is expanded from the collapsed condition of FIG. 5*a* to the expanded condition of FIG. 5*d* would be relatively easily understood by a person skilled in the art. Thus, as shown in FIG. 4, a push force P is applied against the fold lines 13*a* and 14*a* of the end walls 13 and 14 and as the push force P expands the end walls 13 and 14, the container 10 itself progressively expands from the collapsed condition of FIG. 5*a* to the expanded condition of FIG. 5*d*. Thus the side walls 15 and 16 expand and the top and bottom structures 12 and 11 move apart.

FIG. 5*d* represents the commencement of a transitional phase of the container 10 in which it can be seen that the side walls 15 and 16 have now expanded to a position in which the first and second sections 15*b*, 15*c* and 16*b*, 16*c* are essentially at a straight angle to each other or in other words, are at an angle of about 180° to each other. It is of course to be understood that this angle is not necessarily precise, given the type of product being discussed and the materials from which it is made, but essentially the side walls 15 and 16 are flat and there is no further rotational movement available between the first and second sections of the side walls 15 and 16. The side walls 15 and 16 have thus reached their maximum height at the point shown in FIG. 5*d*.

As a consequence of the first and second sections of the side walls 15 and 16 reaching their maximum height, the top and bottom structures 12 and 11 are also spaced apart a maximum amount because the spacing between the top and bottom structures 12 and 11 is controlled their connection with the side walls 15 and 16. In contrast, the end walls 13 and 14 are not yet in position as required and shown in FIG. 5*e*. In order to transition from the position shown in FIG. 5*d* to the position shown in FIG. 5*e*, in the embodiment illustrated, the end walls 13 and 14 must flex. There are alternative arrangements to the requirement for flexing that will be discussed later herein, but flexing is the mechanism employed in the container 10. This flexing mechanism is shown in FIGS. 6*a* to 6*c* and 7*a* to 7*c* as will now be described.

Figure 6A:
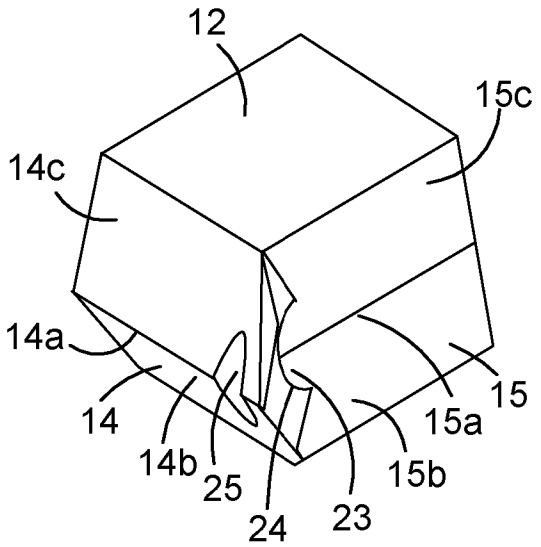
FIGS. 6*a* to 6*c* show a corner section of the container of FIG. 1 expanding to the expanded condition.
Figure 6B:
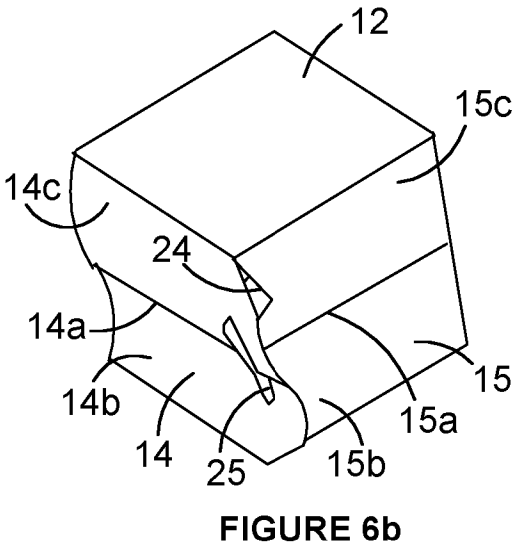
Figure 6C:
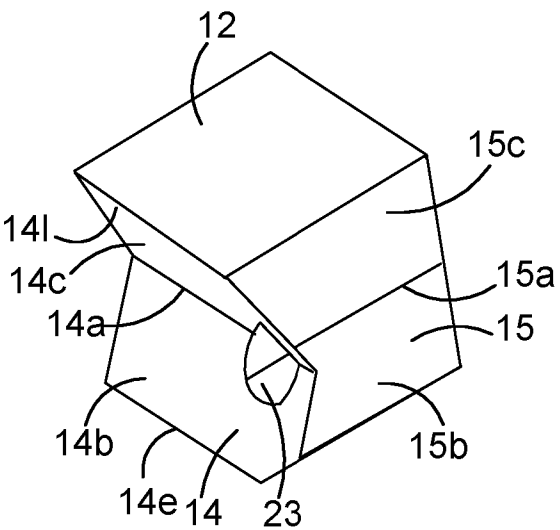
Figure 7A:
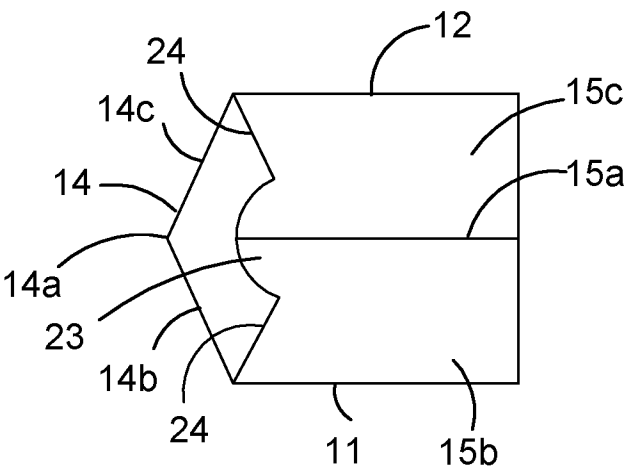
FIGS. 7*a* to 7*c* show the corner section of FIGS. 6*a* to 6*c* in side view.

FIGS. 6*a* to 6*c* show a corner portion of the container 10, which for the purposes of this description, can be the corner between the end wall 14 and the side wall 15 of FIG. 4. FIGS. 6*a* and 7*a* represent the container 10 in the condition shown in FIG. 5*d*, while FIGS. 6*c* and 7*c* represent the container 10 in the operational expanded condition of FIG. 5*e*. It can be clearly seen between FIGS. 6*a*/7*a* and 6*c*/7*c*, that the end wall 14 shifts from a position in which it presents a convex orientation (FIGS. 6*a*/7*a*) when viewed externally of the container 10, to a concave orientation (FIGS. 6*c*/7*c*). Throughout the transition from convex to concave configuration, the side wall 15 remains straight (as does the side wall 16 although that is not illustrated in these figures), with the side wall sections 15*b* and 15*c* forming a generally straight angle between them. Because the side walls 15 and 16 are straight and thus are at maximum height, the height between the top structure 12 and the bottom structure 11 cannot increase. This means that the end wall 14 can also not increase in height to transition to the concave configuration as it would need to do if it were to transition without the first and second sections thereof deforming, bending or flexing. Thus, for the end wall 14 to reach the concave configuration, it must flex or resiliently distort in the manner as illustrated in FIGS. 6*b*/7*b*.

Figure 7B:
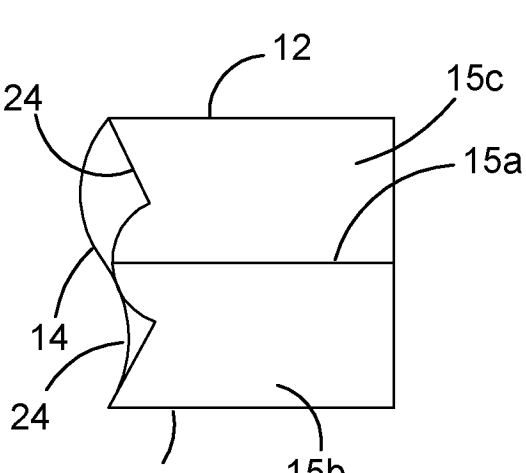
Figure 7C:
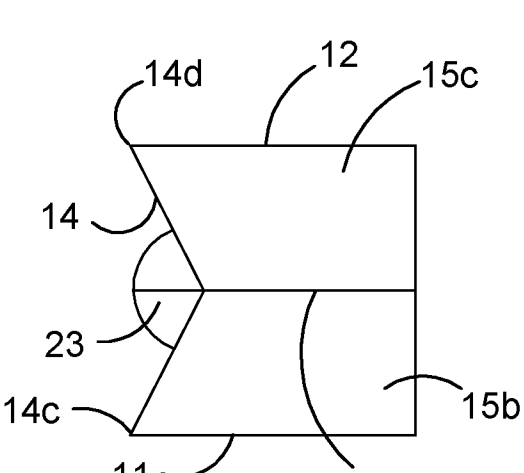

With reference to FIGS. 6*b* and 7*b*, the bending or flexing of the end wall 14 is illustrated by way of the end wall 14 forming a wave shape which allows the wall 14 to bend, flex or deform (distort) in order to shift from the convex configuration in FIGS. 6*a*/7*a* to the concave configuration of FIGS. 6*c*/7*c*. The wave form shown in FIGS. 6*b*/7*b* is shown as a sine wave formation, but it should be appreciated that this is simply to illustrate the flexing or elastic or resilient distortion that the end wall 14 undergoes to reach the concave configuration in FIGS. 6*c*/7*c*. The end wall 14 can resiliently flex or distort or otherwise reconfigure in any suitable manner in order to make the transition required. A perfect sine wave flex is very unlikely to occur. Also, the wave form shown in FIGS. 6*b*/7*b* is shown exaggerated to illustrate the flexing that the end wall 14 undergoes. That level of flex is not evident in the prototype containers constructed to date.

Because of the resilient or elastic nature of the end wall 14, the end wall 14 will toggle, snap or pop into the concave configuration of FIGS. 6*c*/7*c* once it has been pushed a sufficient distance through the transition state between FIGS. 6*a*/7*a* to FIGS. 6*c*/7*c*. This will occur as a result of the load acting on the end wall 14 from the top and bottom structures 12 and 11. That is, the natural or stable state of the end wall 14 is in either of the positions of FIGS. 6*a*/7*a* or FIGS. 6*c*/7*c*. The end wall is unstable in the position of FIGS. 6*b*/7*b*. If insufficient load is applied to the end wall 14 so that the end wall 14 does not transition through the position of FIGS. 6*b*/7*b*, it will return naturally to the position of FIGS. 6*a*/7*a*. However, if sufficient load is applied to the end wall 14 so that the end wall 14 does transition through the position of FIGS. 6*b*/7*b*, it will naturally assume the position of FIGS. 6*c*/7*c*.

Once the end wall 14 has reached the position shown in each of FIGS. 1, 5*e*, 6*c* and 7*c*, the container 10 is properly and operationally expanded. Importantly, the end walls 13 and 14 are maintained in the expanded position of FIGS. 1 and 5*e*, by a load applied to the respective top edges 13*d*, 14*d* and bottom edges 13*e*, 14*e* (see FIGS. 2, 4, 6*c* and 7*c*) by the respective top and bottom structures 12 and 11. This load is applied by the action of the side walls 15 and 16 preventing the top structure 12 lifting away from the bottom structure 11 so preventing the return movement of the end walls 13 and 14 from the concave configuration shown in FIG. 5*e*, to the convex configuration shown in FIG. 5*d*. The container 10 is now essentially locked in the expanded condition of FIG. 5*e* and all that has been required to achieve this is finger pressure P applied in the direction shown in FIG. 4. A single action of pressure applied to the respective end walls 13 and 14 has transitioned the container 10 from the collapsed condition of FIG. 5*a* to the fully expanded and operational condition of FIG. 5*e*.

Further evident from FIG. 5*e* and FIGS. 6*c*/7*c* is that as the end walls 13 and 14 transition to the concave configuration, the locking tabs 23 automatically enter the slots 25. This secures the end walls 13 and 14 against lateral movement (in the direction into or out of the page of FIGS. 7*a* to 7*e*) relative to the side walls 15 and 16 and provides the container 10 with further structural stability. It is to be noted that the locking tabs 23 could be provided with a barb or arrow configuration at their leading or free ends so as to engage on the outer surfaces of the end walls 13 and 14 to further lock the end walls 13 in place. It is to be further noted that the locking tabs 23 could be omitted entirely and the container 10 could still operate effectively.

It is further evident from FIGS. 5*e*, 6*c* and 7*c*, that in the concave configuration of the end walls 13 and 14, the inside surfaces of those end walls rest or engage against the end edges 24 of the side walls 15 and 16. It is the engagement of the end walls 13 and 14 with the end edges 24 which arrests further rotation of the first and second sections 14*b* and 14*c* of the end wall 14 about the fold line 14*a*. Thus, the end edges 24 form abutments that the end walls 13 and 14 engage against in the expanded and operational condition of the container 10 and via that engagement, further rotation of the first and second sections of the end walls 13 and 14 in the direction of rotation from the FIGS. 6*a*/7*a* configuration to the FIGS. 6*c*/7*c* configuration is prevented or arrested.

The abutments described herein (being the end edges) can be straight or curved or otherwise shaped as required. In the figures, the abutments are shown generally straight but this is not essential.

Figure 8:
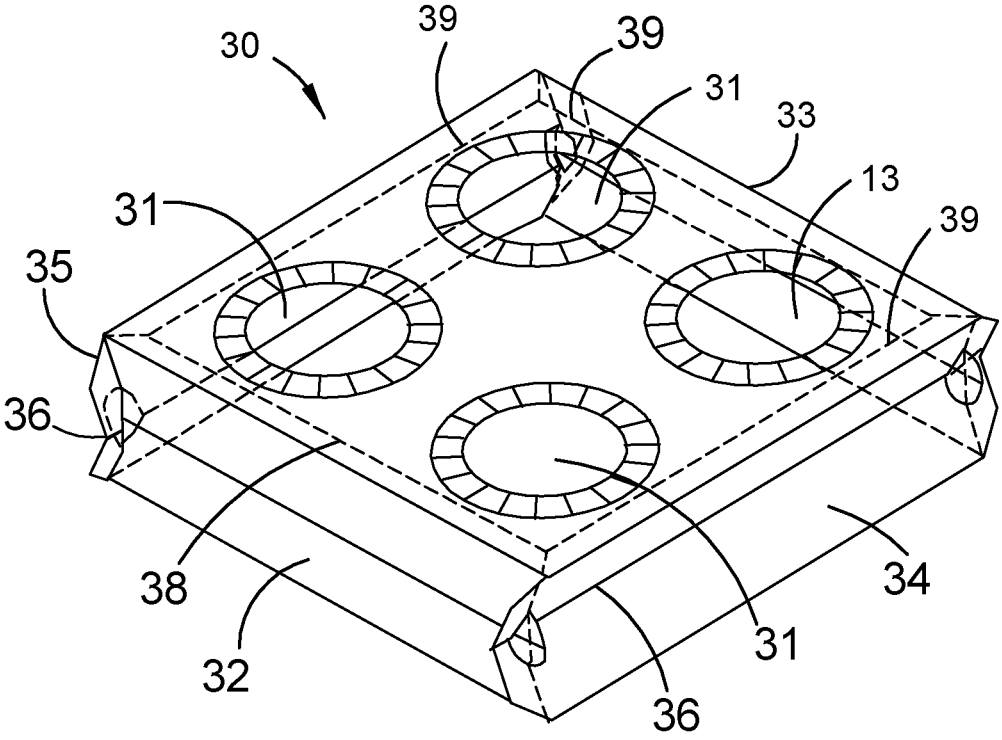
FIG. 8 is a perspective view of a container according to another embodiment of the invention.

FIG. 8 shows an alternative container 30 according to the invention. The container 30 differs from the container 10 only in respect of its square configuration, compared to the rectangular configuration of the container 10, so that the container 30 includes 4 drink cup openings 31.

The container 30 includes side walls 32 and 33 and end walls 34 and 35. In the square configuration of the container 30, the side walls 32 and 33 are of generally the same length as the end walls 34 and 35.

In other respects, the container 30 is the same as the container 10 in that transition of the container 30 from a collapsed condition to an operational expanded condition is the same as the container 10. That is, the end walls 34 and 35 of the container 30 each include central fold lines 36 that, in the collapsed condition of the container 30, can be pushed inwardly to the point at which the end walls 34 and 35 reach the same position shown in FIG. 7*a* of a convex configuration, and thereafter, further pressure applied to the fold lines 36 causes resilient flexing or distortion of the end walls as shown in FIG. 7*b* before the end walls 34 and 35 assume the concave configuration shown in FIG. 7*c*.

Figure 9:
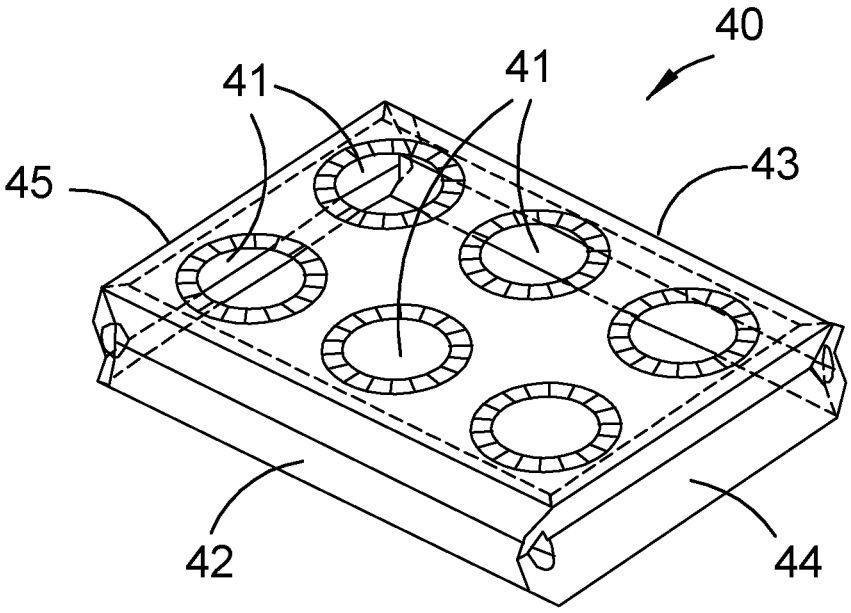
FIG. 9 is a perspective view of a container according to another embodiment of the invention.

FIG. 9 illustrates a further form of the invention in which a container 40 is illustrated which includes six openings 41 for receipt of drink cups. The container 40 returns to a rectangular configuration, in which the side walls 42 and 43 are longer than the end walls 44 and 45. Otherwise, the container 40 operates in the same manner as the containers 10 and 30 previously discussed and so no further discussion in relation with the container 40 is required.

The different containers 10, 30 and 40 illustrate different configurations that embody the invention as described in this application. Thus, each of the containers 10, 30 and 40 include end walls that transition from a convex configuration to a concave configuration through a transition state. In each of the containers discussed above, that transition state involves a flexible or resilient distortion of the end walls as shown in FIGS. 6*b* and 7*b*.

Figure 10:
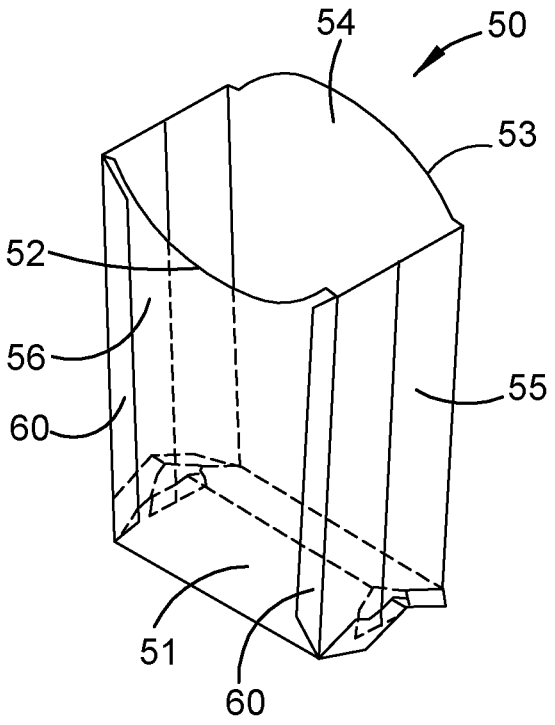
FIG. 10 is a perspective view of a container according to another embodiment of the invention.

The containers 10, 30 and 40 have all been developed for the carriage of drink cups and differ only in respect of the shape of the container (square or rectangular) and the drink cup capacity of the container. To illustrate that the invention can have different forms, uses or applications other than for drink cups, FIG. 10 illustrates an open ended container that could be used for example in the fast food industry for containing hot chips. The container has a structure which is similar to the container 10, except that the container 50 is oriented in an upright condition rather than a generally horizontal condition and the container 50 includes a single end wall 51 rather than a pair of opposite end walls 13, 14 as in the container 10.

The container 50 thus includes a top structure 52, and bottom structure 53 and an open end 54 opposite the end wall 51. Side walls 55 and 56 extend between the top and bottom structures 52 and 53.

Figure 11:
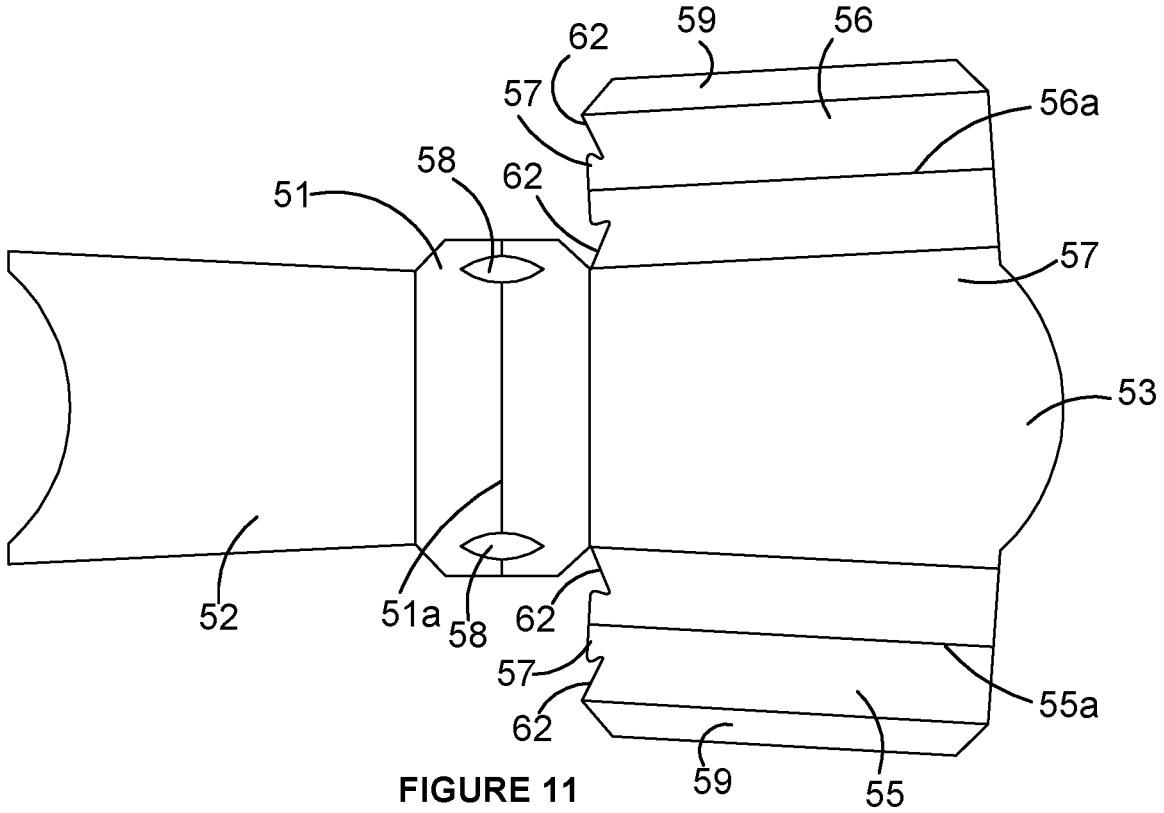
FIG. 11 is a plan view of a blank from which the container of FIG. 10 formed.

The container 50 can be formed from a single blank as shown in FIG. 11. The blank 57 shows each of the features of the container 50 discussed above and further shows central fold lines 51*a*, 55*a* and 56*a* of the end wall and side walls 51, 55 and 56. The blank 57 further shows locking tabs 57 and slots 58. Each of the side walls 55 and 56 includes a glue flap 59 for adhesively connecting to the inside surface of the top structure 52 to create an overlapping section 60 (see FIG. 10).

Figure 12:
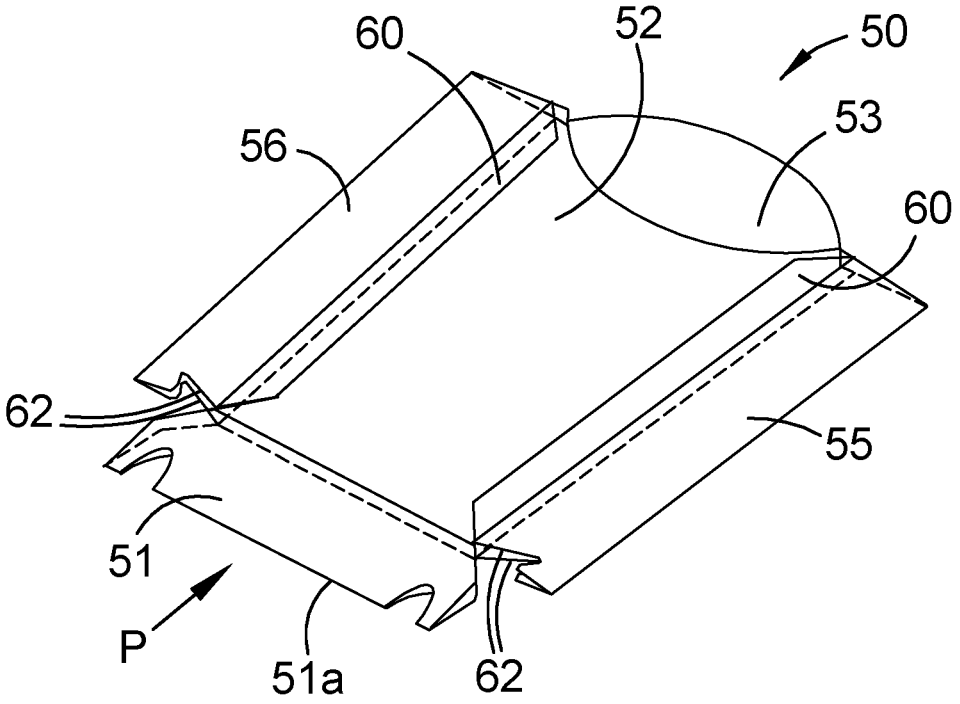
FIGS. 12 to 14 show the sequence of expansion of the container of FIG. 10.

The blank 57 can be die cut from a cardboard sheet and folded into a flat or collapsed condition as shown in FIG. 12, whereby the glue flaps 59 are adhesively connected to the inside or outside surface of the top structure 52 (the outside surface is shown in FIGS. 10 and 12). In the condition shown in FIG. 12, the container 50 is essentially flat.

Figure 13:
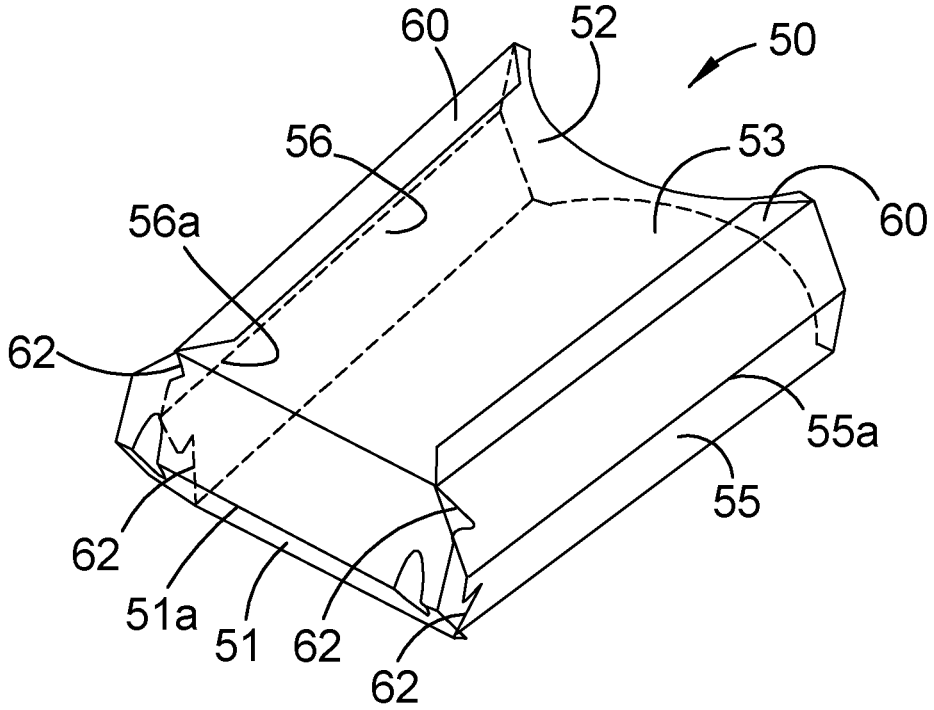

A push force P (see FIG. 12), can be applied to the fold line 51*a* of the end wall 51 to expand the container 50 to the position shown in FIG. 13. That push force P brings the container 50 to the expanded condition of FIG. 13, whereby the end wall 51 assumes the equivalent position of FIGS. 6*a* and 7*a* of the earlier figures. In that position, the end wall 51 has a convex configuration when viewed externally of the container 50. The expansion of the container 50 is not however quite to the same extent as that shown in FIGS. 6*a* and 7*a*, given that the side walls 55 and 56 have not expanded to a point at which the section thereof on either side of the respective fold lines 55*a* and 56*a* describes a straight angle. The sections of the side walls 55 and 56 on opposite sides of the fold lines 55*a* and 56*a* are at a slight angle to each other and thus continue to have a convex configuration when viewed externally of the container 50.

Figure 14:
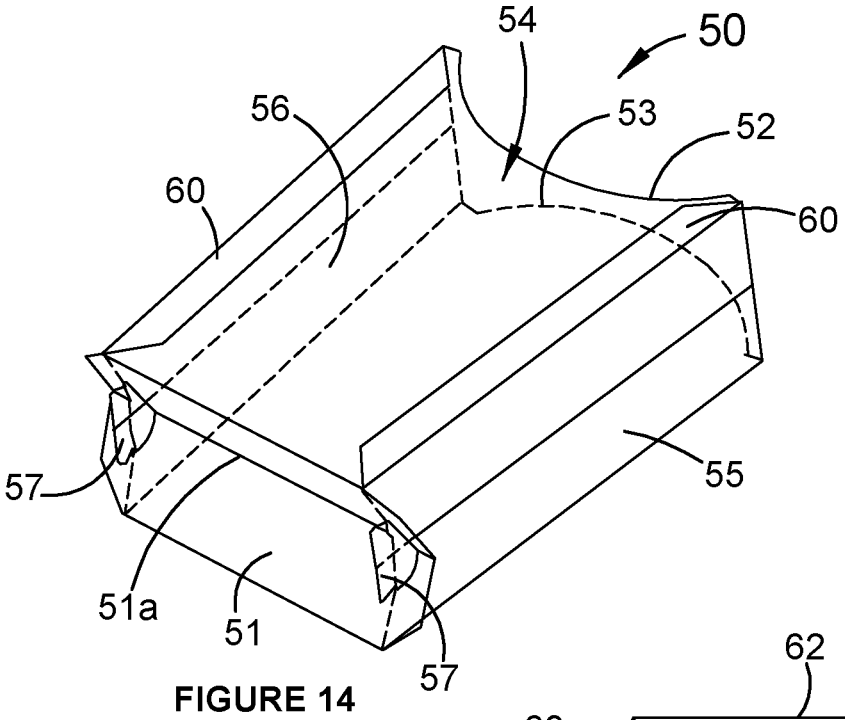

Continuing to push against the fold line 51*a* of the end wall 51 will bring the side walls 55 and 56 to a generally flat configuration (describing a substantially straight angle) and this will represent the maximum spacing between the top and bottom structures 52 and 53. The end wall 51 therefore can no longer continue to expand and thus must resiliently bend, flex or distort similar to that shown in FIGS. 6*b* and 7*b* to bring the end wall 51 into the expanded and operational position shown in FIG. 14. In that position, the locking tabs 57 have extended through the slots 58 and an inside surface of the end wall 51 is in engagement with end edges 62 of the side walls 55 and 56 (see FIGS. 11 to 13). That engagement between the end wall 51 and the end edges 62 arrests further rotation of the end wall sections of the end wall 51 on either side of the fold line 51*a* and a load is applied by the top and bottom structure 52 and 53 to the end wall 51 retain that concave configuration and to retain engagement of the end wall 51 with the end edges 62. The container 50 is thus expanded and operational and ready to receive appropriate food items.

Returning to FIG. 8, it will be readily apparent that instead of providing drink cup openings 31, the upper surface within which those openings 31 are depicted in FIG. 8 could alternatively be solid and could be formed as a hinged lid. For example, the broken line 38 could form a hinge, while the broken lines 39 could be formed as slots or could be cut or slit, so that the majority of the top section of the container 30 could be lifted and hinged about the broken line 38. Such a container could be used to accommodate pizza or cake for example.

Moreover, with respect to any of the containers 10, 30 or 40, the drink cup openings could be modified or changed to accommodate different shaped openings for different items such as different food items.

Returning to FIG. 3, it is to be understood that the side walls 15 and 16 could be located between (sandwiched between) the bottom and top structures 11 and 12 in the collapsed condition of the container 10, rather than projecting outwardly from those structures in the collapsed condition. In that arrangement, the side walls 15 and 16 would still expand to the FIG. 5*d* position, but from a different starting position. This could apply to all embodiments of the invention.

Figure 15A:
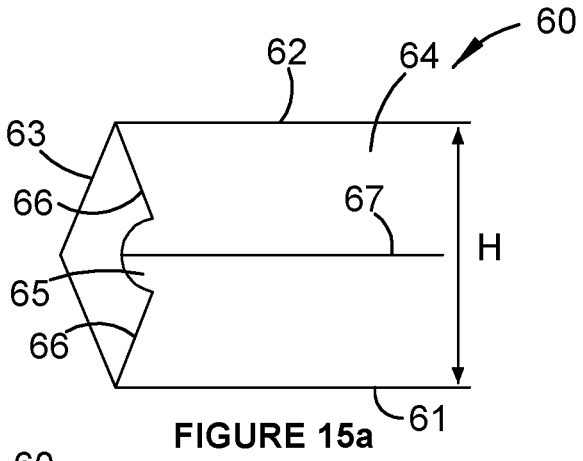
FIGS. 15*a* to 15*c* show a side view of a corner section of a container according to another embodiment of the invention showing the sequence of expansion.
Figure 15B:
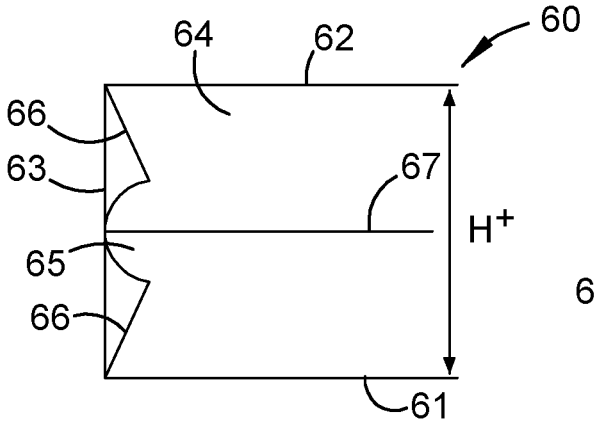
Figure 15C:
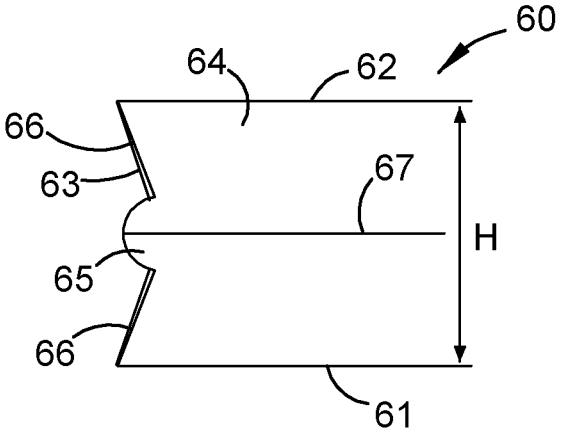

In an alternative form of the container 10, the side walls 15 and 16 do not reach a straight angle as shown in FIG. 5*d*, 6*c* or 7*c*, but rather, the side walls 15 and 16 always maintain a concave or angled configuration from the collapsed condition to the expanded condition when viewed from the exterior of the container 10. This alternative form of the invention is schematically illustrated in FIGS. 15*a* to *c* which show side views similar to FIGS. 7*a* to *c*. The portion of the container 60 of FIGS. 15*a* to *c* has a bottom structure 61 and a top structure 62. The container 60 has an end wall 63 and a side wall 64. The side wall 64 has locking tabs 65 that extend from end edges 66. The end wall 63 has a central fold line 67.

In the position of FIG. 15*a*, the end wall 63 is in the position of FIGS. 6*a*/7*a* of the container 10. However, different from the container 10, and while not clearly apparent from FIG. 15*a* is that the side wall 64 is not fully extended and retains a slight convex (or equally a concave) configuration. In FIG. 15*a*, the spacing between the top and bottom structures 61 and 62 is identified as "H".

Because the side wall 64 is not fully extended in the FIG. 15*a* position, further pressure on the end wall 63 to straighten the end wall 63 is accommodated by further straightening of the side wall 64. By this further straightening, the top and bottom structures 61 and 62 shift further apart so that the spacing between the top and bottom structures 61 and 62 becomes "H+", where H+>H. However, the side wall 64 can be configured so that it resists further straightening and so that it has a natural tendency to return to the FIG. 15*a* position. The side wall 64 thus applies a load to the top and bottom structures 61 and 62 to resist them shifting apart from the spacing H in FIG. 15*a* to the spacing H+ in FIG. 15*b*. That load applies to the end wall 63 and accordingly, when the end wall 63 reaches the position shown in FIG. 15*b*, where it is generally straight, it is in an over center position which is unstable. The end wall 63 thus needs to collapse and with a push load being applied to the end wall 63 to push it further inwardly towards the position of FIG. 15*c*, the end wall 63 will toggle, snap or pop to collapse into the concave configuration of FIG. 15*c*. The load applied to the end wall 63 through the side wall 64 will maintain the end wall 63 in the concave configuration of FIG. 15*c*.

The form of the invention illustrated in FIGS. 15*a* to *c* has evolved to be the form that the container 10 will take in commercialised forms of the invention. Thus, in the assembled form of FIG. 5*e*, the side walls 15 and 16 of the container 10 are likely to be sightly concave or (less likely) convex when viewed from the exterior of the container 10.

Figure 16A:
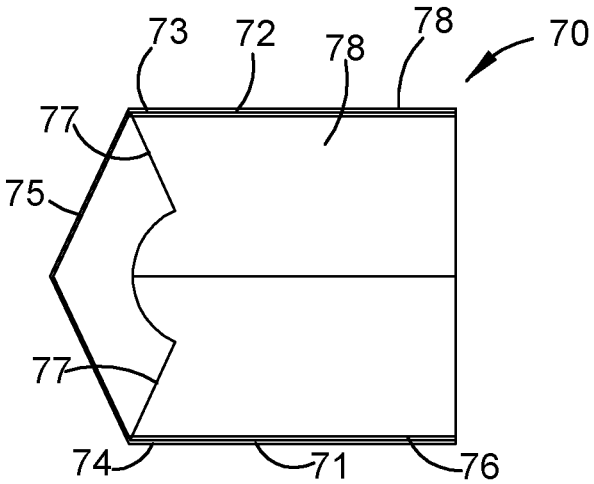
FIGS. 16*a* to 16*c* show a side view of a corner section of a container according to another embodiment of the invention showing the sequence of expansion.
Figure 16B:
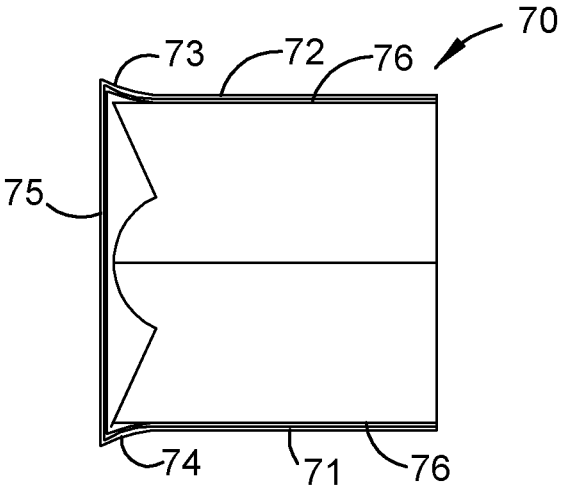
Figure 16C:
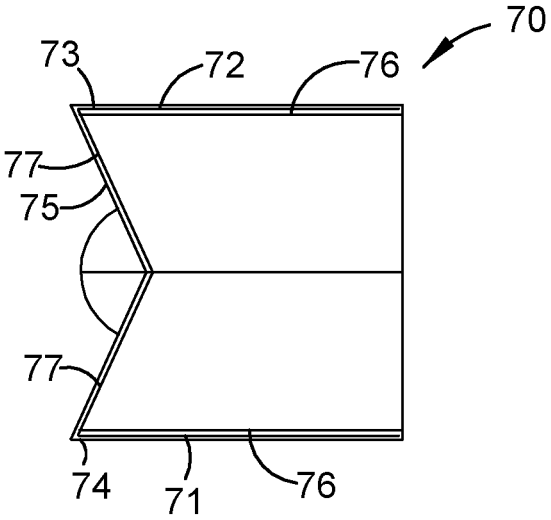

In a further alternative form illustrated in FIGS. 16*a* to *c*, the container 70 has top and bottom structures 71 and 72 that are fixed in spacing relative to each other but which have connecting sections 73 and 74 (see FIG. 16*b*) that connect to the end wall 75 and that can flex or pivot relative to a main body 76 of the top and bottom structures 71 and 72. These connecting sections 73 and 74 flex or pivot relative to the main body 76 of the top and bottom structures 71 and 72 when the top and bottom structures 71 and 72 have reached their positions at the container expanded condition, but prior to the end wall 75 reaching the transition state. Flexing or pivoting of the connecting sections 73 and 74 allows further expansion of the end wall 75 to the over center position and once through that position, the end wall 75 is subject to the load or bias applied by the top and bottom structures 71 and 72 through the connecting sections 73 and 74 to bring the end wall 75 into engagement with the end edges 77 of the side wall 78.

Figure 17A:
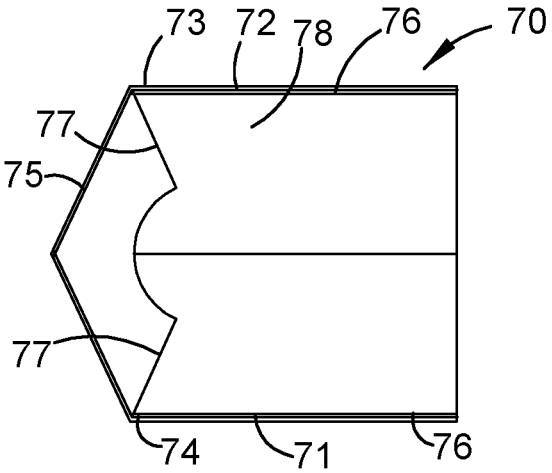
FIGS. 17*a* to 17*c* show a side view of a corner section of a container according to another embodiment of the invention showing the sequence of expansion.
Figure 17B:
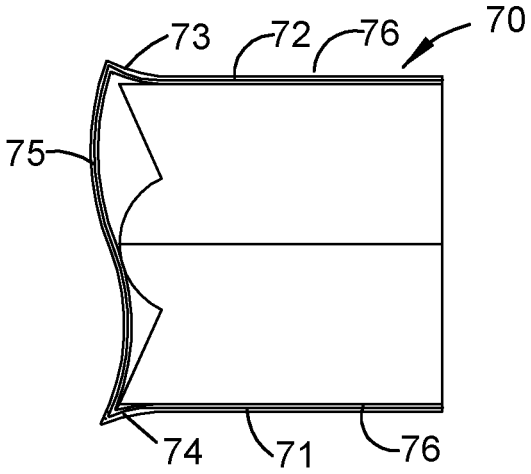
Figure 17C:
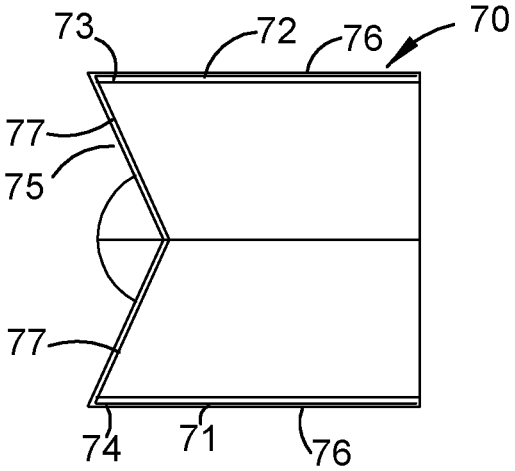
Figure 18A:
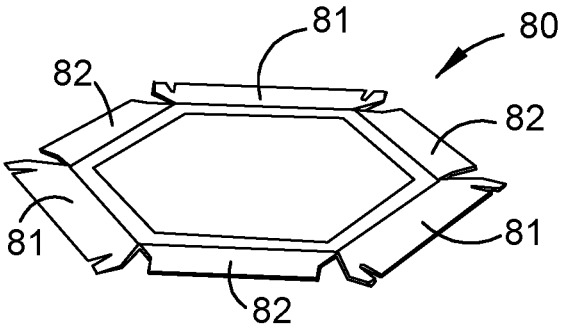
FIGS. 18*a* to 18*d* a container according to another embodiment of the invention which is of hexagonal configuration and showing the sequence of expansion.
Figure 18B:
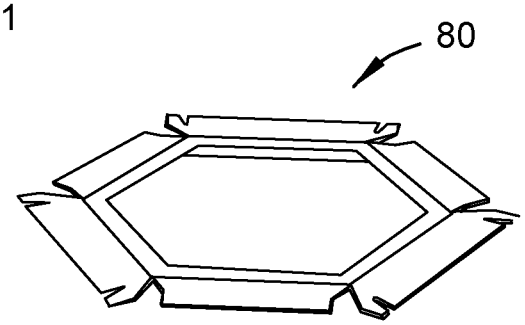
Figure 18C:
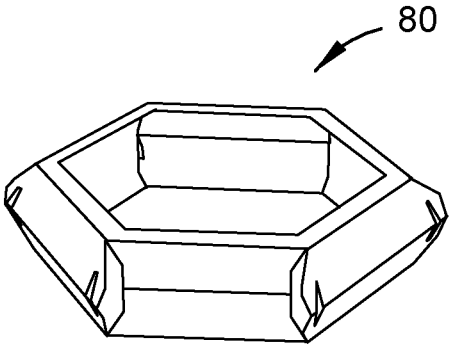
Figure 18D:
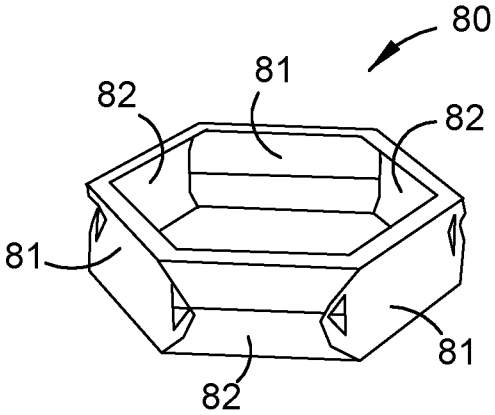

In a further alternative form illustrated in FIGS. 17*a* to *c*, the same container 70 of FIGS. 16*a* to *c* is illustrated expect that the end wall 75 is shown flexing in FIG. 17*b* rather than remaining straight as shown in FIG. 16*b*. In other respects the operation of the container 70 is the same in FIGS. 17*a* to *c* as it is in FIGS. 16*a* to *c*. In FIGS. 17*a* to *c*, the flexing arrangement of FIGS. 7*a* to 7*c* is combined with the flexing or pivoting connecting sections 73 and 74.

Figure 19:
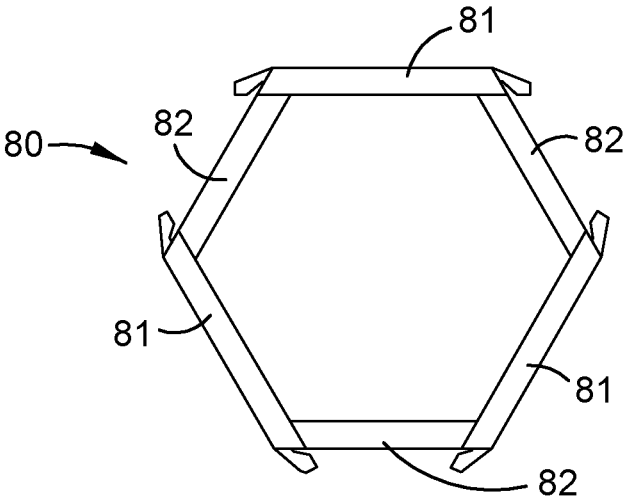
FIG. 19 is a plan view of the container of FIGS. 18*a* to 18*d*.

FIGS. 18*a* to *d* and 19 show yet a further alternative of the invention in which the container 80 is hexagonal. FIG. 19 shows the container 80 in plan view and in that view, the container includes three first walls, end walls or toggling walls which are each numbered 81 and the non-toggling walls are each numbered 82. The walls 81 each operate as per the end walls 13 or 14 of the container 10, while the walls 82 each operate as per the side walls 15 or 16 of the container 10. FIGS. 18*a* to *d* show the container 80 being erected from a collapsed position shown in FIG. 18*a* to an operational expanded condition of FIG. 18*e*. The sequence of expansion is essentially equivalent to the sequence shown in FIGS. 5*a* to 5*e*. These FIGS. 18*a* to *d* illustrate that the invention can be embodied in containers that do not have the toggling walls directly opposite each other and that are other than square or rectangular. The sequence of FIGS. 18*a* to *d* will be readily understood from the earlier figures.

It needs to be appreciated that the figures are not necessarily representative of the actual operation of a container according to the invention. The figures show precise distortion or flexing of the end walls of a container or of connecting sections of a container, or both. In practice, the precision shown in the figures is unlikely to be exhibited. Keeping in mind that many forms of containers according to the invention will have a very short usage life, for example a life that can involve nothing more than travel between a food outlet counter and a table of the food outlet, before the container is discarded, long term structural integrity is not usually a requirement. Thus, the connecting sections shown in FIGS. 16*a* to *c* and 17*a* to *c* can be sections that only occur at the corners of the container, and the connecting sections might be sections that tear or rip to facilitate movement of the end walls 75 through the transition state of FIGS. 16*b* and 17*b*. Between the corners of the container, the top and bottom structures 72 and 71 might bow or bend to allow the movement of the end walls 75 through the transition state. Thus, with reference to FIG. 5*d*, the sections that are circled and marked S at the corners of the container 10 can tear or rip to act in the manner of the connecting sections 73 and 74 of FIG. 16*a* to *c* or 17*a* to *c*, and the top edges 13*d*, 14*d* and bottom edges 13*e*, 14*e* (see FIG. 4) can each bow between the sections S. Despite any tearing or ripping at the sections S, the structural integrity of the container is maintained.

It should further be appreciated that transition of the end walls of the various containers illustrated in the figures through the positions of FIGS. 6*b*, 7*b*, 15*b*, 16*b*, and 17*b* to the operational expanded conditions takes a very short period of much less than a second (a split second) and there is in practice, the travel of the end walls is continuous through the transition state. Any slight damage to the container as might occur for example by tearing at the corner sections S is not great or necessarily noticeable and will not affect the manner in which the container is expected to have its major use, i.e. in the take away food or drink industry.

Figure 20:
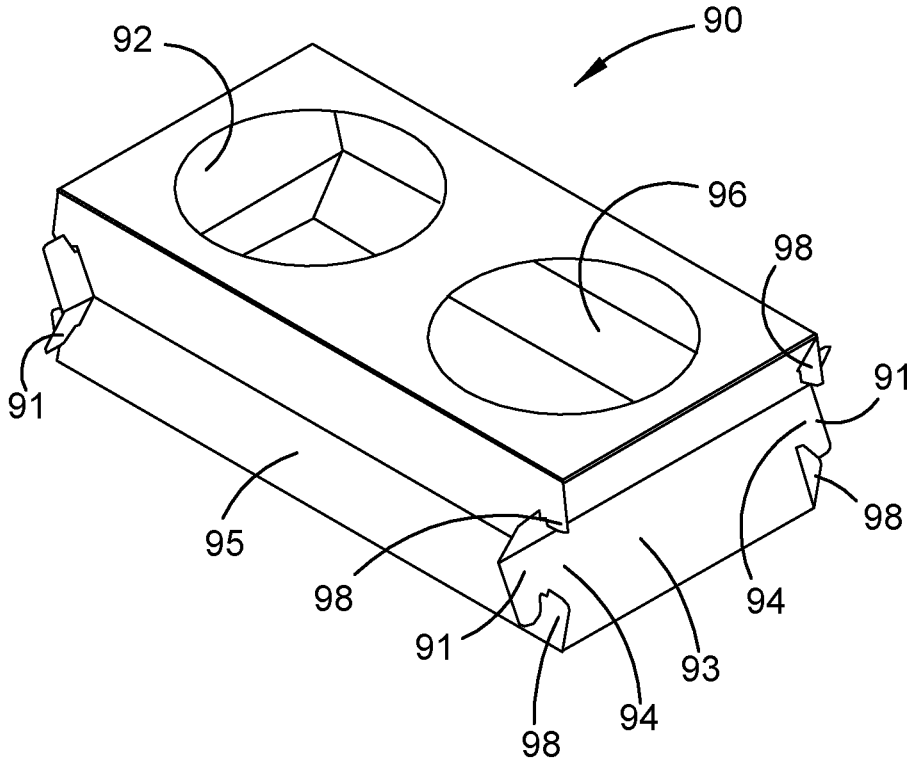
FIG. 20 shows yet a further alternative form of container according to the invention.

FIG. 20 shows a similar form of container to container 10 of FIG. 1, except in relation to the form of locking tabs provided. In FIG. 1, the locking tabs 23 extend from the side walls 15 and 16 and extend through the slots 25 in the end walls 13 and 14 in the container expanded condition of FIG. 1. In contrast, the container 90 of FIG. 20 has locking tabs 91 that extend from the end walls 92 and 93 and that are received in openings 94 formed in the leading edges of the side walls 95 and 96. The openings 94 have return sections 98 that overhang or overlie the end walls 92 and 93 to resist the end walls 92 and 93 from moving away from the position of engagement with the abutment of the side walls 95 and 96. Other features of the container 90 are not marked with reference numerals as they will be readily apparent as being the same features as provided in the container 10.

Those skilled in the art will appreciate that the invention described herein is susceptible to variations and modifications other than those specifically described. It is understood that the invention includes all such variations and modifications which fall within the spirit and scope of the present invention.

Where any or all of the terms "comprise", "comprises", "comprised" or "comprising" are used in this specification (including the claims) they are to be interpreted as specifying the presence of the stated features, integers, steps or components, but not precluding the presence of one or more other features, integers, steps or components.

What is claimed is:

1. A container comprising:

a bottom structure;

a top structure; and a plurality of walls connected to the bottom structure and to the top structure, wherein the container has a container collapsed condition and a container expanded condition, the container being generally flat in the container collapsed condition, and in the container expanded condition the top structure being spaced from the bottom structure a greater distance than in the container collapsed condition, wherein a first of the plurality of walls include first and second sections that connect together at a fold line about which the first and second sections are rotatable between first wall collapsed and expanded conditions, the first section being connected to the bottom structure and the second section being connected to the top structure, and expansion of the first wall from the first wall collapsed condition to the first wall expanded condition causes the top structure to shift away from the bottom structure, and wherein the first wall is expandable by rotation of the first section relative to the second section in a first direction of rotation about the fold line from the first wall collapsed condition and into engagement with an abutment at the first wall expanded condition, whereby engagement of the first wall with the abutment arrests further rotation of the first section relative to the second section about the fold line in the first direction of rotation, the first wall being maintained in the first wall expanded condition by a load applied to the first wall by the top and bottom structures that resists rotation of the first section relative to the second section in a second direction of rotation opposite to the first direction of rotation.

2. The container according to claim 1, wherein movement of the first wall between the collapsed condition and the expanded condition includes passage or travel of the first wall through a transition state in which on one side, the first wall resists movement towards the abutment and which on the other side the first wall drives into engagement with the abutment.

3. The container according to claim 2, wherein the transition state is an over center position.

4. The container according to claim 2, wherein the transition state is a section of travel in which the first wall resiliently flexes on said one side of the transition state and resiliently recovers on said other side of the transition state.

5. The container according to claim 1, wherein the abutment is formed by an edge of another wall of the plurality of walls.

6. The container according to claim 5, wherein the first wall extends generally perpendicular to other of the plurality of walls that forms the abutment and the abutment is formed by a facing edge of the other wall.

7. The container according to claim 6, further comprising a locking tab extending from the facing edge of the other wall and the first wall including an opening through which the locking tab extends upon the first wall assuming the first wall expanded condition.

8. The container according to claim 1, wherein a second of the plurality of walls include first and second sections that connect together at a fold line about which the first and second sections are rotatable between a second wall collapsed and expanded conditions, the first section being connected to the bottom structure and the second section being connected to the top structure, the first and second walls being expandable together whereby expansion of the first and second walls from the collapsed condition to the expanded condition causes the top structure to shift away from the bottom structure, the second wall being expandable in the same manner as the first wall by rotation of the first section relative to the second section in a first direction of rotation about the fold line from the second wall collapsed condition and into engagement with an abutment at the second wall expanded condition, whereby engagement of the second wall with the abutment arrests further rotation of the first section relative to the second section about the fold line in the first direction of rotation, the second wall being maintained in the first wall expanded condition by a load applied to the second wall by the top and bottom structures that resists rotation of the first section relative to the second section in a second direction of rotation opposite to the first direction of rotation.

9. The container according to claim 8, wherein the container is square or rectangular and including first and second end walls opposite each other and a pair of side walls extending between the end walls, the side walls comprising first and second sections that connect together at a fold line about which the first and second sections are rotatable between collapsed and expanded conditions, the first section being connected to the bottom structure and the second section being connected to the top structure, the first and second sections of the side walls being aligned generally straight in the expanded condition of the container so that further movement of the top structure away from the bottom structure is resisted and by that resistance, the top and bottom structures apply a load to the first and second walls that resists rotation of the respective first sections relative to the second sections in a second direction of rotation opposite to the first direction of rotation.

10. The container according to claim 9, wherein each of the first and second walls moves through a transition state between the collapsed condition and the expanded condition in which on one side of the transition state, the first and second walls resist movement towards the abutment and which on the other side of the transition state, the first and second walls drive into engagement with respective abutments.

11. The container according to claim 10, wherein the transition state is an over center position for each of the first and second walls.

12. The container according to claim 8, wherein the container is square or rectangular and including first and second end walls opposite each other and a pair of side walls extending between the end walls, the side walls comprising first and second sections that connect together at a fold line about which the first and second sections are rotatable between collapsed and expanded conditions, the first section being connected to the bottom structure and the second section being connected to the top structure, the side walls defining a generally obtuse angle between the first and second section in the expanded condition of the container, and the side walls applying a load to the top and bottom structures that resists further movement of the top structure away from the bottom structure and by that resistance, the top and bottom structures apply a load to the first and second walls that resists rotation of the respective first sections relative to the second sections in a second direction of rotation opposite to the first direction of rotation.

13. The container according to claim 9, wherein the side walls each have an end edge facing first and second end walls and the end edge forming the abutment against which the first and second walls abut in the expanded condition.

14. The container according to claim 10, wherein the transition state is a section of travel in which the first and second walls resiliently flex on said one side of the transition state and resiliently recover on said other side of the transition state.

15. The container according to claim 1, wherein the container is square, rectangular, hexagonal or octagonal.

16. The container according to claim 1, wherein the top structure includes a hinged lid or cover portion that can be opened for access to the inside of the container.

17. The container according to claim 1, wherein the top structure includes a peripheral rim that defines an open area so that the majority of the top structure is open.

18. The container according to claim 17, wherein the open area is covered by a transparent substrate.

* * * * *